US007151506B2

(12) United States Patent
Knowles et al.

(10) Patent No.: US 7,151,506 B2
(45) Date of Patent: Dec. 19, 2006

(54) ELECTROMAGNETIC ENERGY COUPLING MECHANISM WITH MATRIX ARCHITECTURE CONTROL

(75) Inventors: Gareth Knowles, Williamsport, PA (US); Eli Hughes, State College, PA (US)

(73) Assignee: QorTek, Inc., Williamsport, PA (US)

( * ) Notice: Subject to any disclaimer, the term of this patent is extended or adjusted under 35 U.S.C. 154(b) by 26 days.

(21) Appl. No.: 10/823,237

(22) Filed: Apr. 12, 2004

(65) Prior Publication Data

US 2004/0201526 A1 Oct. 14, 2004

Related U.S. Application Data

(60) Provisional application No. 60/462,719, filed on Apr. 11, 2003, provisional application No. 60/480,445, filed on Jun. 21, 2003.

(51) Int. Cl.
*H01Q 15/02* (2006.01)

(52) U.S. Cl. ..... 343/909; 343/700 MS; 343/853

(58) Field of Classification Search ..... 343/909, 343/700 MS, 876, 853, 755
See application file for complete search history.

(56) References Cited

U.S. PATENT DOCUMENTS

| | | | | |
|---|---|---|---|---|
| 5,589,845 | A * | 12/1996 | Yandrofski et al. | 343/909 |
| 5,721,194 | A * | 2/1998 | Yandrofski et al. | 505/210 |
| 6,260,087 | B1 * | 7/2001 | Chang | 710/100 |
| 6,307,520 | B1 * | 10/2001 | Liu | 343/767 |
| 6,885,345 | B1 * | 4/2005 | Jackson | 343/700 MS |

* cited by examiner

*Primary Examiner*—HoangAnh T. Le
(74) *Attorney, Agent, or Firm*—Michael Crilly, Esq.

(57) ABSTRACT

The present invention relates generally to reconfigurable, solid-state matrix arrays comprising multiple rows and columns of reconfigurable secondary mechanisms that are independently tuned. Specifically, the invention relates to reconfigurable devices comprising multiple, solid-state mechanisms characterized by at least one voltage-varied parameter disposed within a flexible, multi-laminate film, which are suitable for use as magnetic conductors, ground surfaces, antennas, varactors, ferrotunable substrates, or other active or passive electronic mechanisms.

3 Claims, 17 Drawing Sheets

ELECTROMAGNETIC ENERGY COUPLING MECHANISM WITH MATRIX ARCHITECTURE CONTROL

CROSS REFERENCE TO RELATED APPLICATIONS

This application is based upon, and claims priority under 35 U.S.C. § 119(e) from, the following U.S. provisional patent applications: Ser. No. 60/462,719, filed Apr. 11, 2003, and entitled, Pixelized Frequency Selective Surfaces for Reconfigurable Artificial Magnetically Conducting Ground Planes; and, Ser. No. 60/480,445 filed Jun. 21, 2003, entitled Thin, Near Wireless Power Distribution And Control, the contents of which are hereby incorporated by reference.

STATEMENT REGARDING FEDERALLY SPONSORED RESEARCH OR DEVELOPMENT

One or more of the inventions disclosed herein were supported, at least in part, by grants from one or more of the following: the National Aeronautics and Space Administration, (NASA), Contract No. NAS5-03014 awarded by NASA, Goddard Space Flight Center; and Contract no. 1234082, awarded by the California Institute of Technology Jet Propulsion Laboratory (JPL) as a subcontract under JPL's NASA prime contract. The Government has certain limited rights to at least one form of the invention(s).

BACKGROUND OF THE INVENTION

1. Field of the Invention

The present invention relates generally to reconfigurable, solid-state matrix arrays comprising multiple rows and columns of reconfigurable secondary mechanisms that are independently tuned.

More particularly, our invention relates to reconfigurable devices comprising multiple, solid-state mechanisms characterized by at least one voltage-varied parameter disposed within a flexible, multi-laminate film, which are suitable for use as ground surfaces, antennas, varactors, ferrotunable substrates, or other active or passive electronic mechanisms.

2. Description of the Prior Art

Active structures including multiple micro electromechanical systems (i.e., MEMS) are well known in the art. Successful MEMS structures employ a variety of actuators to precisely control the multiple circuit elements involved. The use of digital controllers, that address secondary components arranged in orderly columns and rows, is known as well. However, it is difficult to precisely control large, matrix arrays of MEMS actuators operating at extremely high frequencies in the gigahertz range or above. Microwave MEMS control applications have hitherto been problematical.

Existing power control approaches employing small charge packets offer certain advantages. Efficient power-to-mechanical force conversion is achievable, and very high resolution or accuracy may be realized. However, such designs are inherently gain-bandwidth limited, due to their reliance on small charge packets. From a practical viewpoint, such designs require extensive control circuitry commensurate with the number of devices (actuators) within the system. The complexity and size of wiring buss designs within known power distribution systems increase with actuator density, thereby causing electromagnetic interference, radio frequency interference, and capacitive loss problems. Circuit degradation from mutual coupling is another factor.

There has been considerable work in efforts to develop a number of antenna designs, including both microstrip and phased array, using switch elements. In particular, a number of designs have attempted to achieve such implementation using MEMS. Such 'hard' switching approaches have encountered some very significant obstacles with switching implementation especially with enabling functional MEMS devices that can operate at relatively high, microwave frequencies.

Low-cost, lightweight, thin antennas, especially phased microwave designs, require many separate elements that are arranged in an orderly geometric fashion. This requires large numbers of small and inexpensive antenna switches. In the past, switches that exhibit the appropriate microwave characteristics have been problematical. Although there has been limited success in using MEMS approaches to fabricated small RF switches, the switches demonstrated thus far are expensive and often have relatively poor radiation characteristics, especially above 1 Ghz.

Usually, the hard switching portion of the system is implemented "off" antenna, whereas the soft switch circuitry is more typically incorporated into the antenna itself so as to reduce trace lengths, match impedances and impart flexible or conformal designs. The actual fabrication techniques can include lithography, microcircuit materials such as high temperature co-fired ceramic (HTCC) or low temperature co-fired ceramic (LTCC), roll-to-roll printing and may include either only passive elements in its incorporation or active elements such as thin film transistors that are amenable to compatible integration with the antenna substrate materials and processes.

A typical matrix architecture controlled performance antenna might have hundreds, thousands, or even tens or hundreds of thousands of individual elements, each with a number of tuned elements to control local phase and impedance and interconnections with other antenna elements. Efficient and low-cost control of the large number of tuning elements is a key requirement for a typical pixelated antenna approach. Clearly, connecting wires directly between each tuning element and a control system is unwieldy for even a small number of elements and impractical for arrays with large numbers of elements.

Electrically conducting metallic ground planes have been successfully used for many years in the design of a wide variety of antenna systems. However, there are several major drawbacks associated with using conventional metallic ground planes for antenna applications. For example, horizontally polarized antennas, such as dipoles, ordinarily are spaced at least a quarter-wavelength above their ground plane to achieve optimal performance, and ground planes of this type to support surface waves, which are undesirable in many antenna applications. Recently the concept of an artificial magnetic conductor (AMC) ground plane was introduced as a means of mitigating many of the problems associated with the use of conventional electrically conducting ground planes.

The term artificial magnetic conductor (AMC) typically refers to a structure comprising a dielectric layer having a conducting sheet on one surface and a frequency selective surface (FSS) on the other surface. The FSS is typically an array of conducting patterns supported by a non-conducting surface (the surface of the dielectric layer).

An individual conducting pattern, repeated over the surface of the FSS, may be referred to as a unit cell of the FSS. Conventionally, the unit cell is repeated without variation over the FSS. Typically, the unit cell is a square shaped conducting patch repeated in a grid pattern, for example as described in U.S. Pat. No. 6,525,695 to McKinzie et al. However, more complex shapes are possible.

At a resonant frequency, the AMC behaves as a perfect magnetic conductor, and reflected electromagnetic waves are in phase with the incident electromagnetic waves. This effect is useful in increasing the radiated output energy of an antenna, as radiation emitted backwards from the antenna can be reflected in phase from an AMC backplane, and hence can contribute to the forward emitted radiation, as any interference will be constructive.

Conventional AMC technology is described by D. Sievenpiper, et al., *IEEE Trans. Microwave Theory Tech.,* vol. MTT-47, pp. 2059–2074, November 1999 and F. Yang, et al., pp. 1509–1514, August 1999. Thin AMC ground planes with thicknesses on the order of 1/100 or less of the electromagnetic wavelength can be effectively used to design low-profile horizontally polarized dipole antennas. The use of an AMC in this case allows the antenna height to be considerably reduced to the point where it is nearly on top of the AMC surface. In addition, AMC ground planes also possess the added advantage of being able to suppress undesirable surface waves.

While the conventional AMC ground planes can enhance the performance of many commonly used antennas, they are typically narrow band and lack the flexibility required for use in low-profile, frequency-agile antenna systems.

U.S. Pat. No. 6,483,480 to Sievenpiper et al. describes a tunable impedance surface having a ground plane and two arrays of elements, the one array moveable relative to the other. Int. Pat. Pub. No. WO94/00892 and GB Pat. No. 2,253,519, both to Vardaxoglou, describe a reconfigurable frequency selective surface in which a first array of elements is displaced relative to a second array. U.S. Pat. No. 6,690,327 to McKinzie et al. describes a mechanically reconfigurable AMC. However, mechanical reconfiguration of an array of elements can be difficult to implement.

U.S. Pat. No. 6,469,677 to Schaffner et al. describes the use of micro-electromechanical system (MEMS) switches within a reconfigurable antenna. U.S. Pat. No. 6,417,807 to Hsu et al. and U.S. Pat. No. 6,307,519 to Livingston et al. also describe MEMS switches within an antenna. U.S. Pat. No. 6,448,936 to Kopf et al. describes a reconfigurable resonant cavity with frequency selective surfaces and shorting posts. However, these patents are not directed towards a reconfigurable AMC.

U.S. Pat. No. 6,525,695 and U.S. Pat. App. Pub. No. 2002/0167456, both to McKinzie, describe a reconfigurable AMC having voltage controlled capacitors with a coplanar resistive biasing network. U.S. Pat. No. 6,512,494 to Diaz et al. describes multi-resonant high-impedance electromagnetic surfaces, for example for use in an AMC. Int. Pat. Pub. No. WO02/089256 to McKinzie et al., U.S. Pat. App. Pub. No. 2003/0112186 to Sanchez et al., and U.S. Pat. App. Pub. No. 2002/0167457 to McKinzie et al. describe the control of the sheet capacitance of a reconfigurable AMC. U.S. Pat. No. 6,028,692 to Rhoads et al. describes a tunable surface filter having a controllable element having an end-stub.

Approaches described in the prior art may allow the tuning of a resonant frequency of an AMC, but may not allow the change of other parameters such as resonance width, or allow reconfiguration of multiple band AMCs. Typically, adjustments are made over the whole surface of the AMC, not allowing for local adjustments. Also, reconfigurable antenna and digital matrix control architecture with single source supply are not disclosed.

Patents and published U.S. patent applications referenced in this application are incorporated herein by reference. Co-pending U.S. patent applications to one or more of the present inventors are also incorporated herein by reference, including: U.S. application Ser. No. 10/755,539, filed Jan. 12, 2004, to Werner (concerning metaferrite properties of an AMC); and U.S. application Ser. No. 10/712,666 filed Nov. 13, 2003 to Jackson concerning a reconfigurable pixelated antenna system.

What is required is reconfigurable, solid-state matrix arrays comprising multiple rows and columns of reconfigurable secondary mechanisms that are independently tuned.

SUMMARY OF THE INVENTION

A reconfigurable matrix array of secondary circuit elements disposed within or upon a multi-laminate substrate is controlled by varying a parameter related to at least one of the electromagnetic properties of a substrate component, such as permittivity. To ameliorate the switching problems discussed above that have been encountered previously with extremely high frequency MEMS devices, multiple 'soft' switches are employed in a "matrix" architecture within a preferred multi-laminate substrate. For example, a flexible substrate bearing a phased array antenna system may be controlled by digitally addressing rows and columns of the preferred matrix to vary the dielectric permittivity in localized regions, ultimately adjusting or controlling the frequency or phase of signals of interest.

The present invention has immediate advantage and application in four technology areas: (1) advanced measurement and detection, namely, low cost detector arrays and in situ micro-instruments; (2) large aperture systems, namely, large optical systems, antennas, and wavefront control; (3) low power microelectronics, namely, low power distribution and control systems; and (4) low cost ground-based adaptive optic systems.

The preferred embodiment applies controlled voltage (or, less typically, controlled current) through its row-column matrix architecture to adjust secondary mechanisms (i.e., RF switches) by modifying critical electromagnetic characteristics or parameters. In other words, "hard" switches do not directly switch interconnected secondary elements. Instead, hard switches control secondary mechanisms (i.e., solid-state circuit elements or adjacent materials) that adjust physical-chemical properties, such as permittivity, that vary with voltage. Since permittivity is directly related to resonance, variable secondary mechanisms function as varactors, ferrotunable substrates, variable-phase or variable impedance antennas, and/or other voltage-controlled elements. The voltage-controlled circuit that adjusts antenna parameters is referred to as 'soft' adaptive circuitry. Through the approach, a plurality of electromagnetic performance parameters may be adjusted and optimized. For example, antenna characteristics involving impedance, phase relationships, resonance, emission frequencies, emission directivity, alt-azimuth steering, standing-wave ratio, and the like can be controlled.

The row-column architecture of the present invention increases in importance with the number of elements comprising the antenna. The row-column address portion of the invention provides the high-speed adaptation needed for antenna with larger arrays of elements. For applications such as cell phones and small portable equipment with low antenna element count, preference would be given to analog switching that would employ an individual hard switch for each antenna element or sub-array adjustment (soft adaptive) circuit.

The preferred electronic, matrix architecture layer is bonded, embedded within or otherwise coupled to the multi-laminate substrate, preferably with the matrix architecture exposed. The sheet-like substrate may be flexible, semi-rigid, or rigid. Exemplary active material layers include a mirror, an array of antenna elements, or other arrays of MEMS devices. A thin layer that supports the matrix of switches enabling power distribution may be directly bonded, embedded or otherwise coupled onto either the substrate supporting the active elements which now reside opposite of the electronic layer, or directly bonded, embedded or otherwise coupled to a reaction surface.

In one embodiment, a multi-pixel, frequency selective surface (i.e., FSS) has selectable interconnections between conducting patches to provide a desired electromagnetic pattern. The FSS can be used in a reconfigurable artificial magnetic conductor (i.e., AMC). Through the matrix architecture geometry, the AMC can be dynamically reconfigured for operation at one or more desired frequencies. Reconfigurable matrix arrays as disclosed facilitate the design of low-profile, reconfigurable phased antenna systems and ground planes.

In alternative embodiments actuators are coupled to the electronic layer to communicate with the matrix architecture circuitry. The i-$j^{th}$ row actuator may be bonded using conductive epoxy to the i-$j^{th}$ column actuator within the thin electronics layer. A solid-state power switch is disposed adjacent to each actuator along the electronic layer. Alternately, a power switch may communicate with each row and column or row only.

A matrix architecture antenna embodiment features voltage-controlled tuning of individual antenna elements, and the phasing of individual elements or groups of elements. All of the latter adjustments are effectuated with tunable dielectric elements. This tuning occurs at the local phase of individual elements or groups of elements. The proposed approach is similar to RF MEMS switches in the sense that functionality of the reconfigurable aperture can be changed by opening and closing different connections between patches.

For efficient matrix addressing, a row-column approach is suggested. In a typical display, pixels are arranged into N rows and M columns. The number of rows and columns may or may not be equal. The use of a transistor at each element makes overall control of the display straightforward. Typically rows, connected to the gates of element transistors, are selected one at a time. The transistors in the selected row are turned ON and the data required for each element in the row is applied through orthogonal column lines. Low-cost, off-the-shelf integrate circuits are available to provide row and column signals, typically for pennies per line, with single line update times typically near ten microseconds. This approach is employed to control tunable elements of a matrix antenna array.

As an alternative approach to hard switching (MEMS switching) antenna systems, we propose a matrix architecture antenna structure in which the RF tuning of individual antenna elements, the connections of individual antenna elements to other antenna elements, and possibly the local phase of individual elements or groups of elements, is varied and controlled using tunable dielectric elements. This tuning occurs at the local phase of individual elements or groups of elements. The proposed approach is similar to RF MEMS switches, in the sense that the functionality of the reconfigurable aperture can be changed by opening and closing different connections between these patches.

In the present invention, the performance of an electromechanical coupling device such as an antenna includes controlling a secondary sub-circuit array of soft (passive components only) circuits with a sub-circuit array of hard switching type devices (typically external, but not necessarily). Variation in the secondary sub-circuit array is caused by controlling the output of a corresponding single hard switch device (or dual in the case of row-column architecture) using a single digital controller and a single power supply. The controller enacts ON or OFF states in the sub-circuit array of hard switches so as to control the electrical values (typically voltage) at the secondary sub-circuit array. A first matrix of sub-circuits are soft circuits that are normally physically located as part of the antenna or integrated onto the antenna substrate. These are passive circuits but with an adjustable parameter, typically permittivity. A second matrix of sub-circuits are typically physically located off antenna and would normally include hard switching mechanisms such as MOSFETS or MEMS.

Thus, an object of the invention is to provide a reconfigurable coplanar waveguide, microstrip array antenna, and other wave propagation systems that possess individual or sub-array waveguide or transmission velocity control mechanisms composed of devices without hard switching.

A further object of the invention is to provide a reconfigurable multilayer coplanar waveguide or microstrip array that possess individual or sub-array control mechanism composed of multiple devices without hard switch devices.

A further object of the invention is to provide secondary hard switch devices that control an electric parameter such as voltage or current supply to the individual or sub-array control mechanism.

A further object of the invention is to provide a controllable array of multiple, independently controllable mechanisms arranged in orderly columns and rows that are capable of adjusting the waveguide or transmission velocity parameters.

A further object of the invention is to provide a controllable array of multiple, independently controllable mechanisms arranged in orderly columns and rows that are capable of being externally controlled by varying an electrical parameter, an example being a voltage controller.

A further object of the invention is to enable external control of a wave propagation system by varying electrical feeds of the sub-array control mechanism using digital control of an array of electric profile control mechanisms.

A further object of the invention is to provide prefabricated trace architecture connecting the individual or sub-array control mechanisms fabricated together with the waveguide structure and the outputs of the array of external electrical feed control devices.

A further object of the invention is to enable external control by varying electrical feeds of the sub-array control mechanism using digital control of an array of electric profile control mechanisms consisting of electronic switches.

A further object of the invention is to provide prefabricated trace architecture connecting the individual or sub-array control mechanisms fabricated together with the waveguide structure and the outputs of the array of external electrical feed control devices such as MOSFETS, MEMS or other hard switches.

A further object of the invention is to enable external control by varying electrical feeds of the sub-array control mechanism using digital control of an array of electric profile control mechanisms consisting of electronic switches with one switch per individual or sub-array control mechanism.

A further object of the invention is to enable external control by varying electrical feeds of the sub-array control mechanism using digital control of an array of electric profile control mechanisms consisting of electronic switches in a row-column matrix configuration with one switch per individual or sub-array control mechanism.

A further object of the invention is to enable external control by varying electrical feeds of the individual or sub-array control mechanism using digital control of an array of electric profile control mechanisms consisting of electronic switches in a row-column matrix configuration with one switch per individual or sub-array row and one switch per individual or sub-array column.

A further object of the invention is to provide control of the outputs of the electrical feeds of the individual or sub-array control mechanism using a single power source and digital control whereof of the electronic switch mechanisms.

A further object of the invention is to enable the reconfigurable waveguide or microstrip array and individual or sub-array control mechanism to be realized on flexible substrate.

A further object of the invention is to provide prefabricated trace architecture connecting individual or sub-array control mechanisms fabricated together with the waveguide structure and the outputs of the array of external electrical feed control devices such as MOSFETS, MEMS or other hard switches to be fabricated using any software controlled automated procedure such as photolithography, roll-to-roll printing, etching, metal deposition directly onto the substrate.

A further object of the invention is to enable the reconfigurable coplanar waveguide or microstrip array and individual or sub-array control mechanism to be realized on a flexible substrate consisting of polymer substrates.

A further object of the invention is to enable multi-layer constructions of reconfigurable coplanar waveguide or microstrip array and individual or sub-array control mechanism to be realized on high frequency laminate systems and flex circuit materials.

A further object of the invention is to enable multi-layer constructions of reconfigurable coplanar waveguide or microstrip array and individual or sub-array control mechanism to be realized on multiple layers of flexible adhesiveless laminates.

A further object of the invention is to enable multi-layer constructions of reconfigurable coplanar waveguide or microstrip array and individual or sub-array control mechanism to be realized on multi-layer single-clad copper laminate crystalline polymer (LCP), multi-layer Low Temperature Co-fired Ceramic (LTCC) or as discrete attached or bonded devices.

A further object of the invention is to enable multi-layer constructions of reconfigurable coplanar waveguide or microstrip array that incorporate phase relationship control between individual or sub-arrays of elements using the digital controlled switching of the external matrix of switches.

A further object of the invention is a digital controlled center frequency adjustment of an antenna at the duty cycle of the individual solid-state switches in the matrix architecture themselves gating the power characteristics supplied to the soft circuits associated with each individual or sub-array of waveguide elements.

A further object of the invention is a digital controlled center frequency adjustment of an antenna at the duty cycle of the individual solid-state switches in the matrix architecture themselves gating the power characteristics supplied to the soft circuits associated with each individual antenna elements in a phased antenna array.

A further object of the invention is to provide a low mass antenna structure that is frequency tunable by digital control of the matrix of external hard switches controlling the electrical feed to each individual or sub-array of waveguide or transmission velocity control mechanisms composed of devices that do not require hard switching.

A further object of the invention is to provide a low mass antenna structure that is frequency tunable by digital control of the matrix of external hard switches controlling the electrical feed to an antenna integrated array of ferrotunable materials so as to adjust the of waveguide or transmission velocity parameters of each individual or sub-array of antenna element(s).

A further object of the invention is to provide a low mass antenna structure that is frequency tunable by digital control of the matrix of external hard switches controlling the electrical feed to an antenna integrated array of voltage controlled variable capacitor devices as to adjust the waveguide or transmission velocity parameters of each individual or sub-array of antenna element(s).

A further object of the invention is to construct a frequency agile phased array antenna comprised of an array of antenna elements each with in-built soft circuit that uses voltage controlled ferrotunable materials as part of a soft circuit with adjustments wherein the waveguide or propagation parameters of each element is controlled by a single supply whose electrical output to each individual soft circuit is via digital control having a matrix array of external hard switches.

A further object of the invention is object is to construct a thin and lightweight frequency agile phased array antenna on thin metallic, Kapton or comprised of an array of antenna elements each with in-built soft circuit fabricated via thin film lithography, multi-layer crystalline polymer dielectric material or Low Temperature Ceramic constructions that uses voltage controlled ferrotunable materials as part of a soft circuit with adjustments in the waveguide or propagation parameters of each element is controlled by a single supply whose electrical output to each individual soft circuit is via digital control having a matrix array of external hard switches.

A further object of the invention is to construct a frequency agile phased array antenna comprised of an array of antenna elements each with in-built soft circuit that uses voltage controlled Barium Strontium Titanate (BST) oxide Magnesium Titanate (MgTi) or Lead Strontium Titanate (PST) materials as variable dielectric components in a RC or RLC circuit fabricated on thin metallic substrate such as copper foil.

A further object of the invention is to construct a frequency agile phased array antenna comprised of an array of antenna elements each with in-built soft circuit that uses voltage controlled flexible Kapton PST film incorporated into multi-layer crystalline polymer dielectric materials on flexible secondary substrates.

A further object of the invention is to construct a frequency agile phased array antenna comprised of an array of antenna elements each with in-built soft circuit that uses voltage controlled ferrotunable materials as part of a soft circuit with adjustments wherein the waveguide or propagation parameters of each element is controlled by a single supply whose electrical output to each individual soft circuit is controlled by digital control of a matrix array of external hard switches and that provides long term stability at low temperatures, and which can operate with a low voltage power supply.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
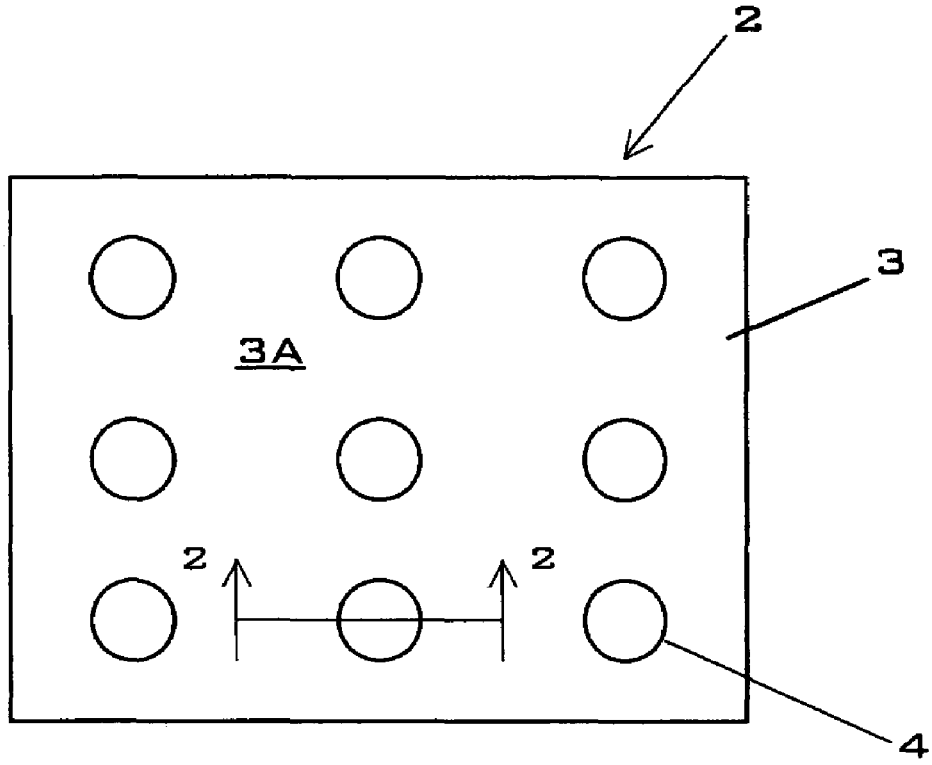
FIG. 1 is a combined diagrammatic and pictorial view of a patch matrix array constructed and controlled in the manner described hereinafter.
Figure 2:
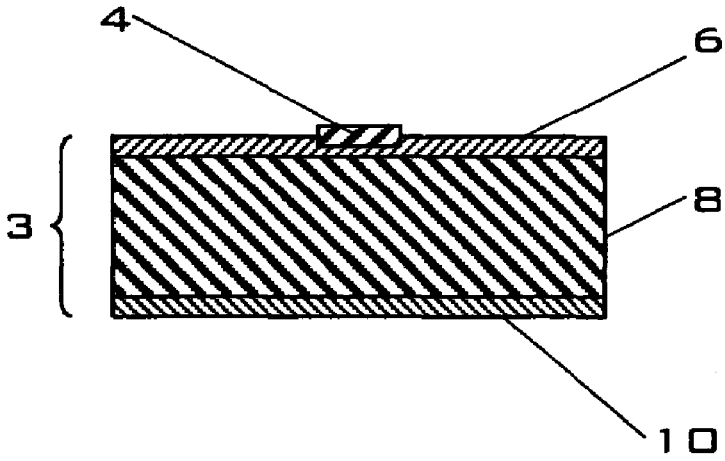
FIG. 2 is an enlarged, fragmentary sectional view taken generally along line 2—2 of FIG. 1.

With initial reference directed now to FIGS. 1 and 2 of the appended drawings, a reconfigurable matrix array of secondary passive but adjustable circuit elements has been generally designated by the reference numeral 2. Supportive substrate 3, that is constructed as described hereinafter, supports a plurality of electrically actuated, passive but adjustable circuit elements 4 that form a sub-circuit array. They may also function as passive components, such as resistive loads. In any event, the multiple secondary circuit elements 4 (FIG. 1) are arranged in a 3×3 matrix on the surface 3A of the substrate. A variety of matrix configurations are possible. The preferred "matrix architecture" arrangement arrays the secondary circuit elements 4 in a grid pattern of ordered rows and columns, for digital control in the manner described hereinafter. A second set of circuit elements may comprise a variety of active components such as transistors, integrated circuits, field effect transistors (FET's) or the like; collectively or individually functioning as antennas or switches or other applications. These "hard" or switching elements are normally external to the structure in FIG. 1. However, they may also be discretely incorporated into a multi-ply substrate construction.

The circuit elements 4 (FIGS. 1 and 2) in the illustrated matrix may comprise circuits that can be adjusted individually by turning ON and OFF hard switches to produce variations in the electromagnetic structure. Alternatively, these secondary elements may comprise CCD devices or other semiconductor components.

Secondary elements 4 can be conducting patches that are selectively interconnected with passive but adjustable circuits that are themselves controlled via a second MEMS switch, transistor (such as thin film transistors), other semiconductor device, photoconductors (and other optically controlled switches), other approaches known in the electrical arts, or a combination of methods. These second switches may be selected using electrical signals, magnetic fields, electromagnetic radiation (including light), thermal radiation, mechanical effects (such as actuation), vibrations, mechanical reorientation, or other method. An electromagnetic structure can have a plurality of square or rectangular conducting patches arranged in a square or rectangular grid, selectively inter-connectable using switches. However, other shapes of conducting patches, and other interconnection arrangements are possible.

For example, the unit cell of an electromagnetic structure can have a configuration of permanently interconnected elements, for example by providing metal or other conducting strips between conducting patches, or through provision of any desired conducting pattern. Switches can be provided to selectively interconnect one or more other conducting regions within the unit cell so as to achieve another configuration. For example, each unit cell of an antenna (or some number thereof) can be provided with a first conducting region, an adjustable passive sub-circuit, and a second conducting region, the two conducting regions being variably electrically interconnected by controlling the output of a corresponding hard switch whose output varies the field voltage across some portion of the passive sub-circuit.

Electrically conducting patches for a reconfigurable electromagnetic structure can comprise metal (such as copper, aluminum, silver, gold, alloy, or other metal), conducting polymer, conducting oxide (such as indium tin oxide), conducting (e.g. photo-excited or doped) semiconductor material, or other material. Electrical conducting materials are well known in the materials science arts.

The conducting patches can be of identical shape and size and be distributed uniformly over a surface of the dielectric layer, or may vary in shape, size, and/or distribution parameter (such as spacing). For example, circular, triangular, polygonal, or other shaped patches may be used. The patches may have some three-dimensional character, for example through curvature, if desired. Transistors can provide selectable electrical interconnections between conducting patches or secondary elements 4, to provide a reconfigurable frequency selective surface. As is well known, a transistor can be operated as a switch, providing effectively an open circuit or closed circuit between two transistor terminals, determined by the presence or otherwise of an electrical signal at a third terminal. Transistors or other switching devices can also be used to modify the properties of tunable resonant circuits, which as described below can be used to provide controllable electrical interconnections between conducting patches. MEMS devices can also be used as switches, for example as described in U.S. Pat. No. 6,11469,677 to Schaffner et al. MEMS switches can comprise semiconductors such as silicon, oxides, conducting films such as metal films, dielectric materials, and/or other materials, as are known in the art.

Figure 3:
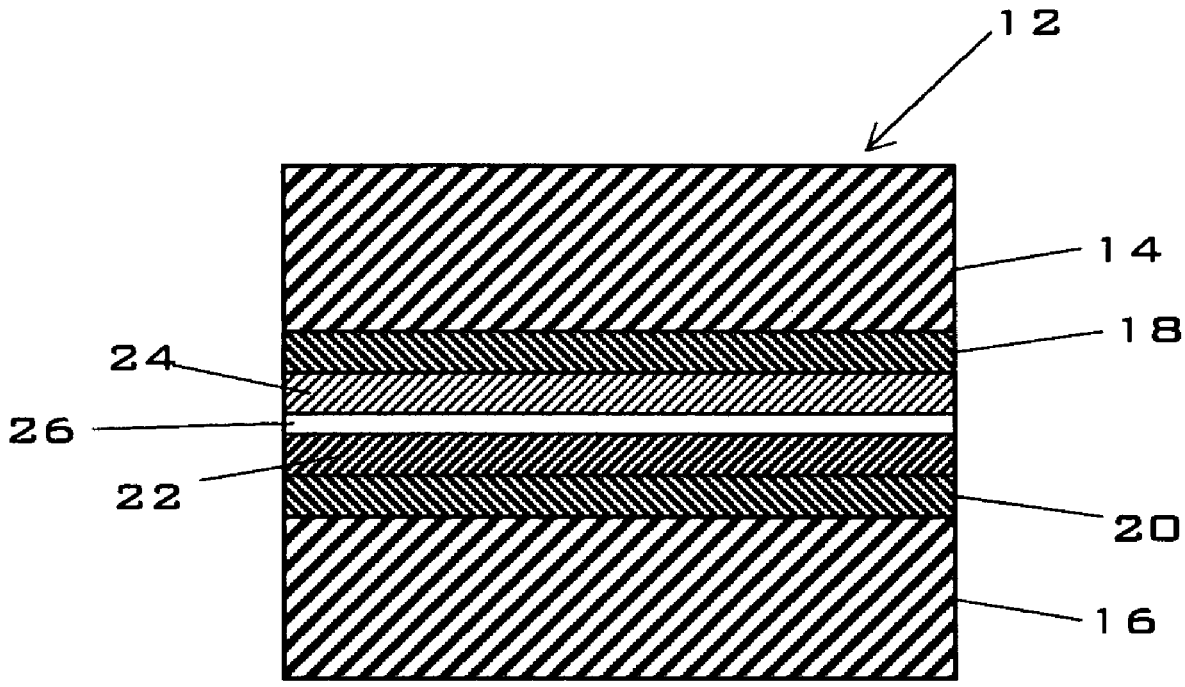
FIG. 3 is an enlarged, fragmentary sectional view of an integrated, ultra light, multi-layer substrate constructed according to the best-known mode of the invention.

Expanding the above matrix architecture concept, a sheet-like, biomorph composited structure 12 may comprise multiple layers as in FIG. 3 including layers with active, controllable secondary components arranged in a matrix. The lightweight multi-laminate structure 12 can be flexible and durable, and large sheets may be stored in spools or rolls. The outer layers 14 and 16 preferably comprise an ultra, high-strain acrylic that is flexible when warm and more rigid when cold. Layers 18 and 20 are PVDF-TFE materials enabling a locally deformable antenna or electromagnetic structure.

Dielectric layer 24 comprises a ferrotunable material, one example being a BST thin film, with a matrix circuit embedded therein. This BST layer 24 is a high dielectric whose permittivity is dependent upon applied voltage. The embedded matrix circuit involves numerous secondary circuit elements disposed as desired through the matrix architecture control means discussed elsewhere herein. Layer 26 is a flexible, non-conducting polymer sheet. Adjoining layer 22 may include embedded control utilized in a matrix arrangement as seen in FIGS. 1 and 2. The resulting matrix application may present a generalized electromagnetic structure, in which frequency characteristics of the secondary circuits embedded within the matrix in BST layer 24 are varied by permittivity changes caused by changing voltages applied by the embedded circuits, for example, in layer 22, that affect local permittivity within adjoining regions of the BST layer. By frequency controlling regions of the surface, as aforesaid, the embedded secondary elements within BST layer 24, for example, may function as a frequency variable, voltage-controlled, microwave antenna array.

A number of dielectric layer materials are known in the art. The dielectric layer may comprise a plastic film or sheet (for example, as used for printed circuit boards), a glass or ceramic layer, foam, gel, liquid, gas (such as air), or other non-conducting material. The dielectric layer 24 may include multiple components, for example a tunable dielectric material in a sandwich or other structure with a conventional (i.e. non-tunable dielectric) plastic film.

Figure 4:
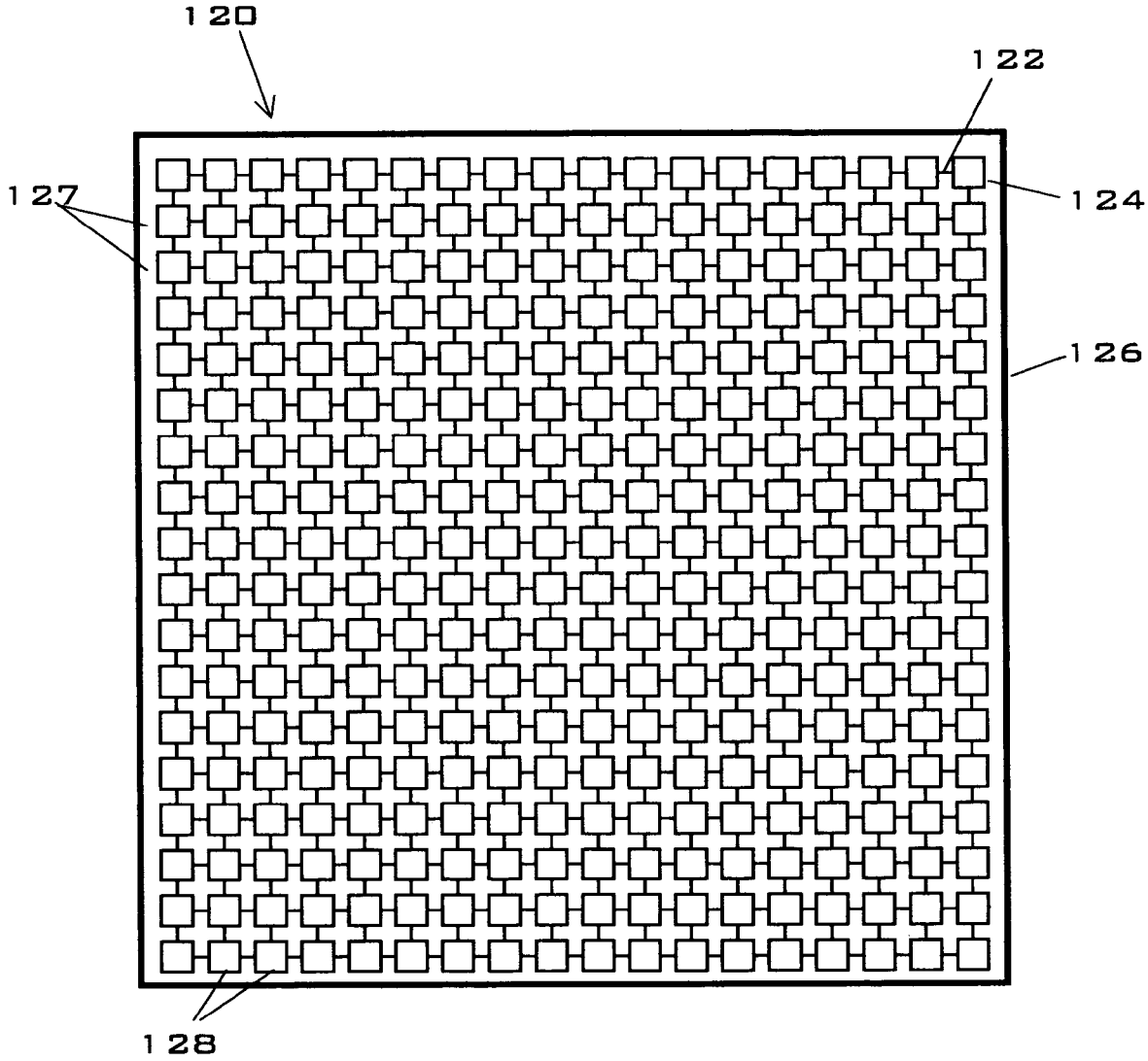
FIG. 4 is a fragmentary plan view of an exemplary matrix array architecture.

With reference now directed to FIG. 4, an embedded matrix arrangement may be configured as a reconfigurable antenna (i.e., AMC) 120. An antenna or electromagnetic structure is formed on the top 124 of a dielectric layer 126 that may be supported upon a rigid, metallic back plate. Multiple secondary active circuit elements 122 are disposed in a grid-like matrix arrangement comprising multiple rows 127 and columns 128. Lines between adjacent elements 122 indicate an electrical connection. A matrix architecture address electromagnetic structure can be formed by the multiple interconnected conducting elements 122 which can function as pixels. The grid formation of multiple elements is adjusted by changes in passive element parameters in a lower substrate layer similarly arranged in a matrix, that are induced by controlling the appled field or voltage output of a second hard switch. This can, for example, vary dielectric permittivity so as to effect localized frequency characteristic alterations. The circuit elements 122 may be switched ON or OFF in various patterns, as is common in array-type digital control circuits. Conducting patches are selectively interconnected using the passive but adjustable components whose input values are gated by a second array of MEMS switches, transistors (such as thin film transistors), other semiconductor devices, photoconductors (and other optically controlled switches), other approaches known in the electrical arts, or a combination of methods.

As the term is used herein, a selected switch is substantially equivalent to a closed switch. Switches can be selected using electrical signals, magnetic fields, electromagnetic radiation (including light), thermal radiation, mechanical effects (such as actuation), vibrations, mechanical reorientation, or other method.

For example, transistors can be used to provide selectable electrical interconnections between conducting patches, so as to provide a reconfigurable frequency selective surface. As is well known, a transistor can be operated as a switch, providing effectively an open circuit or closed circuit between two transistor terminals, determined by the presence or otherwise of an electrical signal at a third terminal.

Transistors or other switching devices can also be used to modify the properties of tunable resonant circuits, which as described below can be used to provide controllable electrical interconnections between conducting patches.

MEMS devices can also be used as switches, for example as described in U.S. Pat. No. 6,11469,677 to Schaffner et al. MEMS switches can comprise semiconductors such as silicon, oxides, conducting films such as metal films, dielectric materials, and/or other materials, as are known in the art.

Figure 5:
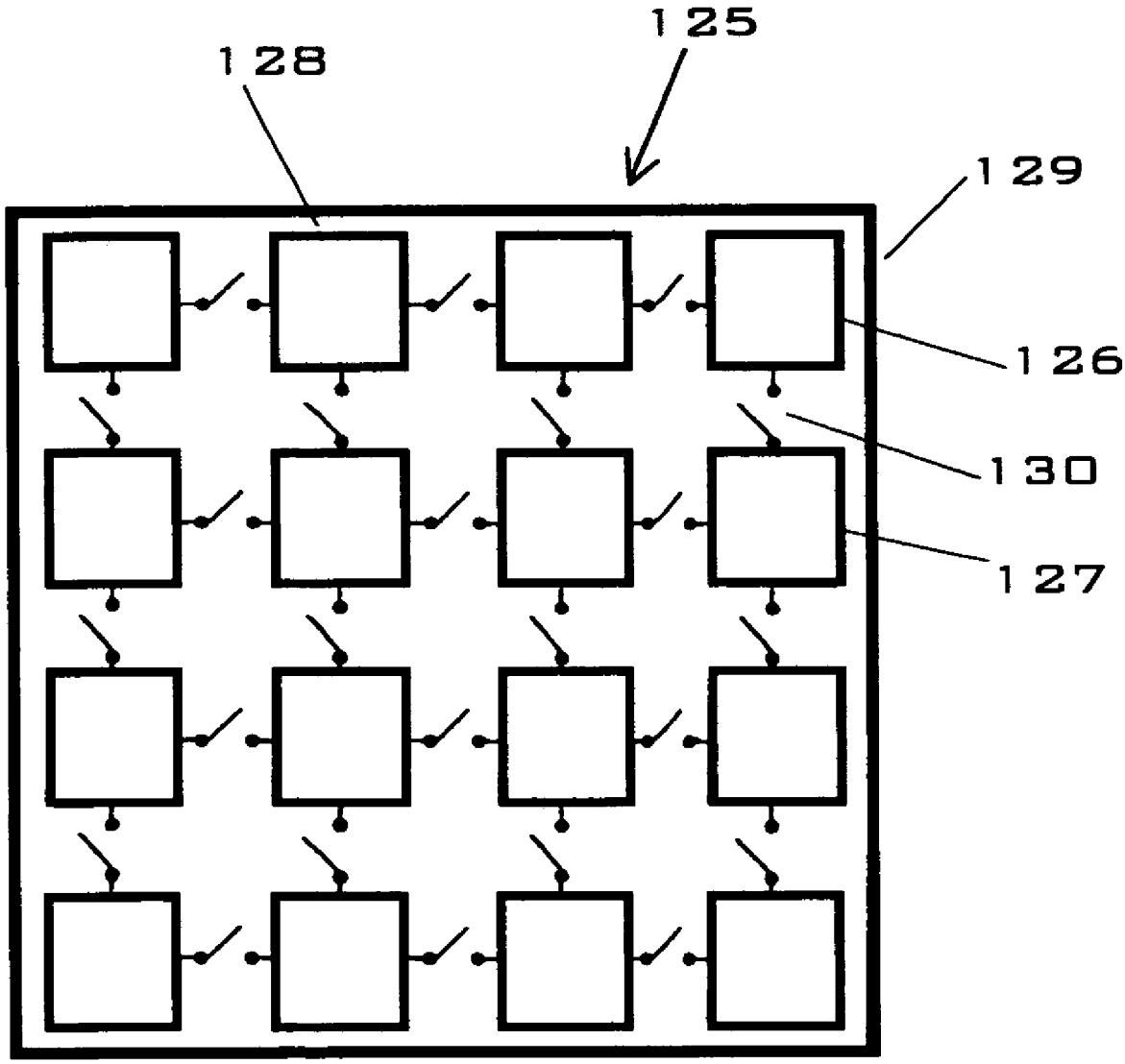
FIG. 5 is an enlarged, fragmentary view of a typical 4×4 matrix of conducting patches seen in FIG. 4.

FIG. 5 schematically illustrates a reconfigurable electromagnetic structure 125. Numerous controllable secondary elements 126, 127 are arranged in a matrix on surface 128 of a substrate 129. In the matrix architecture embodiment depicted, various conduction elements 126, 127 may or may not be electrically interconnected as indicated by switches 130.

Figure 6:
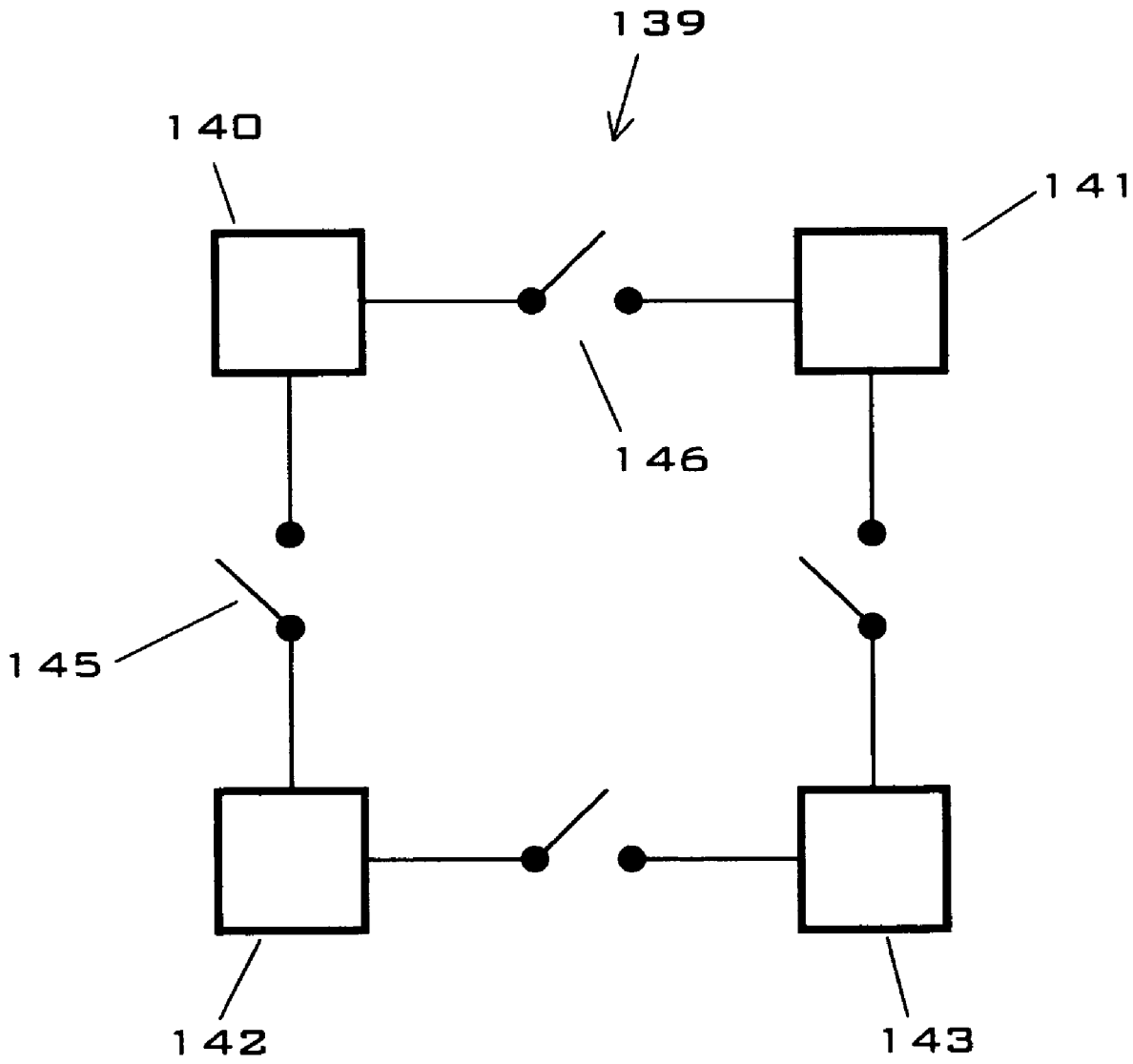
FIG. 6 is a pictorial view diagrammatically illustrating elements that are interconnected for switching in a preferred matrix array.

FIG. 6 diagrammatically shows an inter-element switch 139 comprising adjustable passive circuit and associated switches. Individual elements 140–143 are disposed in a matrix and controlled by column circuits 145 and row circuits 146. The circuits may actually comprise embedded secondary elements in an adjoining substrate layer that controls the visible matrix elements 140–143 seen by the viewer.

Figure 7:
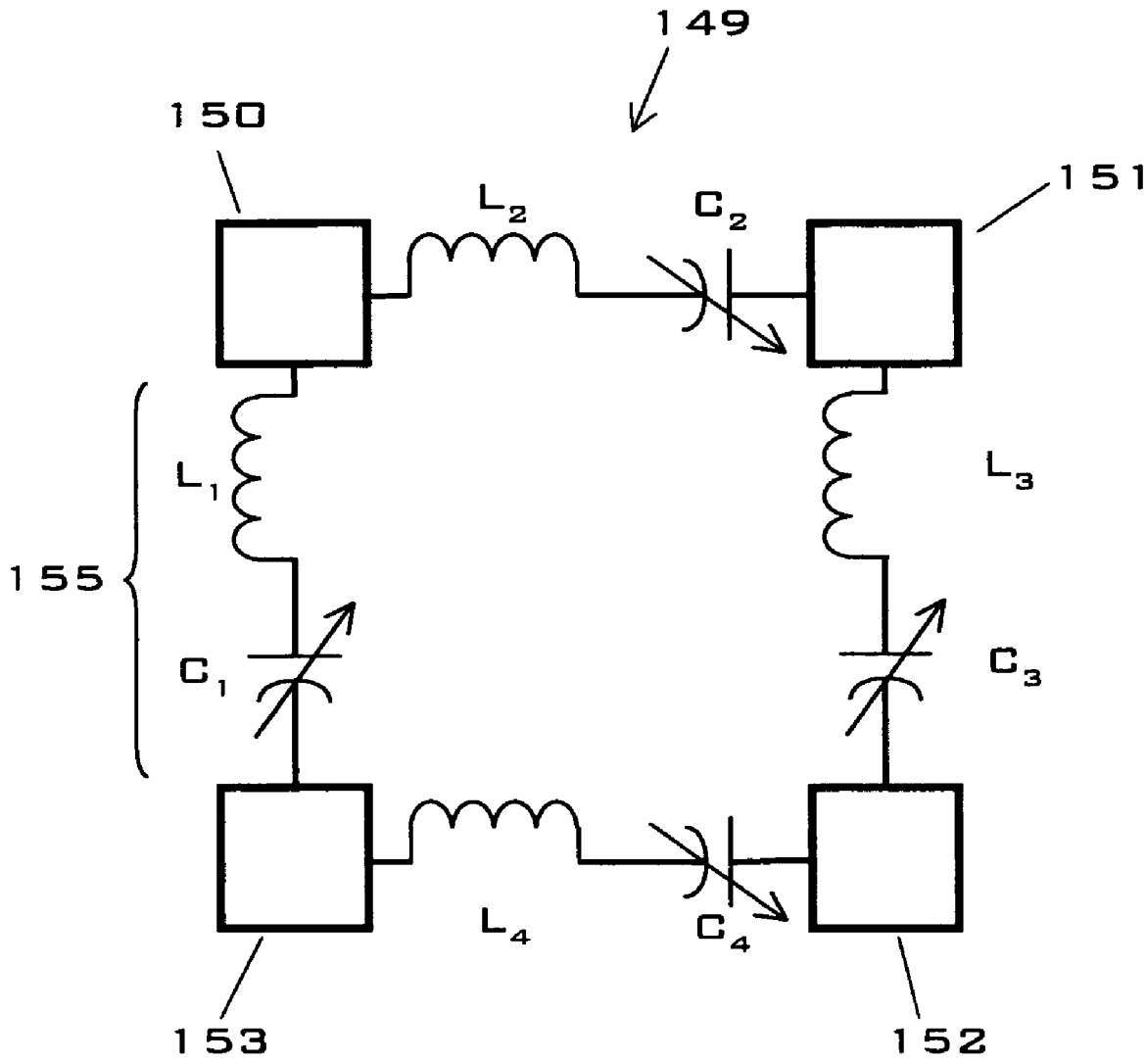
FIG. 7 is a pictorial view diagrammatically illustrating elements that are interconnected in a matrix array with series-connected L/C reactive elements.
Figure 8:
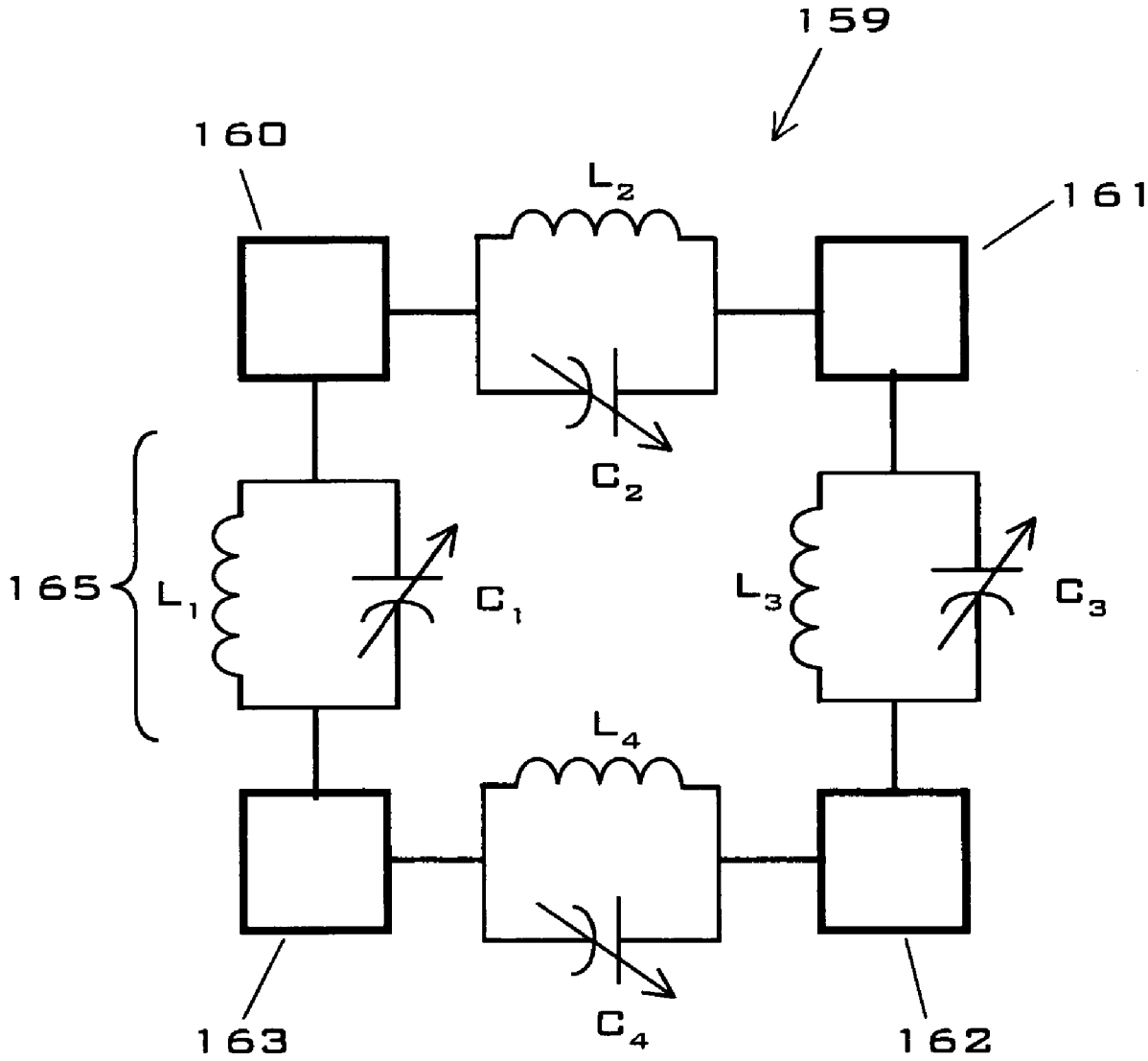
FIG. 8 is a pictorial view diagrammatically illustrating elements that are interconnected in a matrix array with parallel-connected L/C reactive elements.

Similarly, in FIG. 7, the matrix 149 has secondary subcircuit elements 150–153 forming elements that are interconnected by series-connected, reactive L/C connections. For example, the series L/C connection 155 comprises a variable capacitor C1 connected between element 153 and an inductor L1, that leads to element 150. Through an adjoining matrix of switches (i.e., embedded within another substrate layer as in FIG. 3) the capacitance of C1 may be varied. Similarly, matrix 159 of FIG. 8 has secondary circuit elements 160–163 interconnected by parallel-connected, reactive L/C connections 165. In either case a reactive L/C interconnection can be designed to act as a short circuit (i.e., a closed switch) or an open circuit (i.e., an open switch) over a certain limited, predetermined ranges of frequencies. The series L/C connection 155 can also be regarded as a band-pass filter for certain applications; connections 165 can be thought of as band-limiting filters. Variable capacitors C1 provide enable frequency agility, by varying the resonant frequency of the L/C network. This capability provides even greater flexibility in the design of reconfigurable electromagnetic structures that may incorporate AMC ground planes.

Approaches to tunable capacitors include MEMS devices, tunable dielectrics (such as ferroelectrics), electronic varactors (such as varactor diodes), mechanically adjustable systems (for example, adjustable plates, thermal or other radiation induced distortion), other electrically controlled circuits, and other approaches known in the art. Tunable dielectrics can provide wide tunability, compatibility with thin film electronics technology, and potentially very low cost. Currently available tunable dielectrics, for example barium strontium titanate (BST), can provide greater than 80% dielectric constant tunability with loss characteristics useful for applications up to about 10 or 20 GHz. Other materials promise similar tunability with low-loss characteristics for frequencies approaching the THz range and with improved temperature stability compared to BST.

Figure 9:
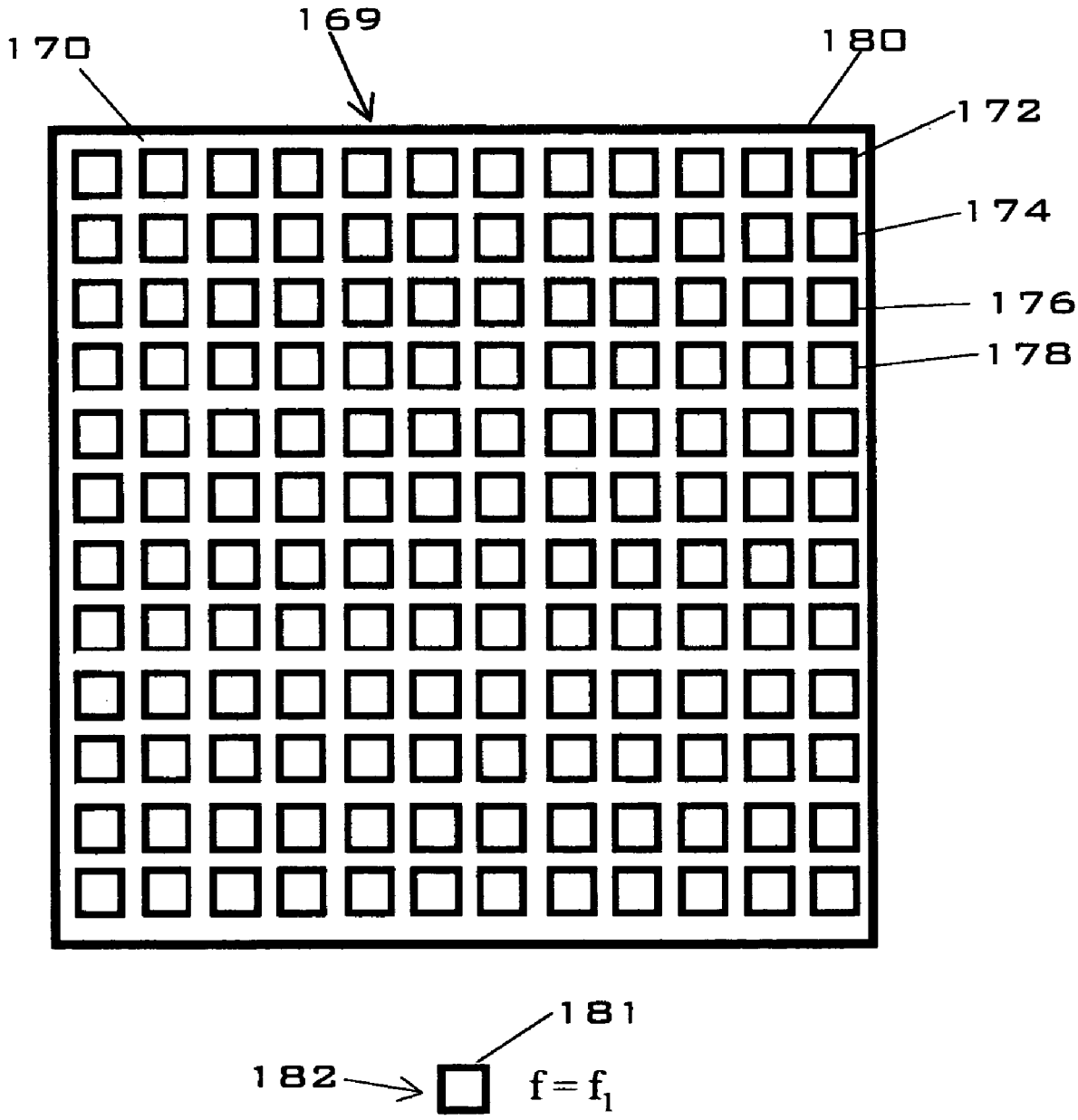
FIGS. 9–12 are combined diagrammatic and pictorial views of reconfigurable ground planes constructed in accordance with our matrix array concept.
Figure 10:
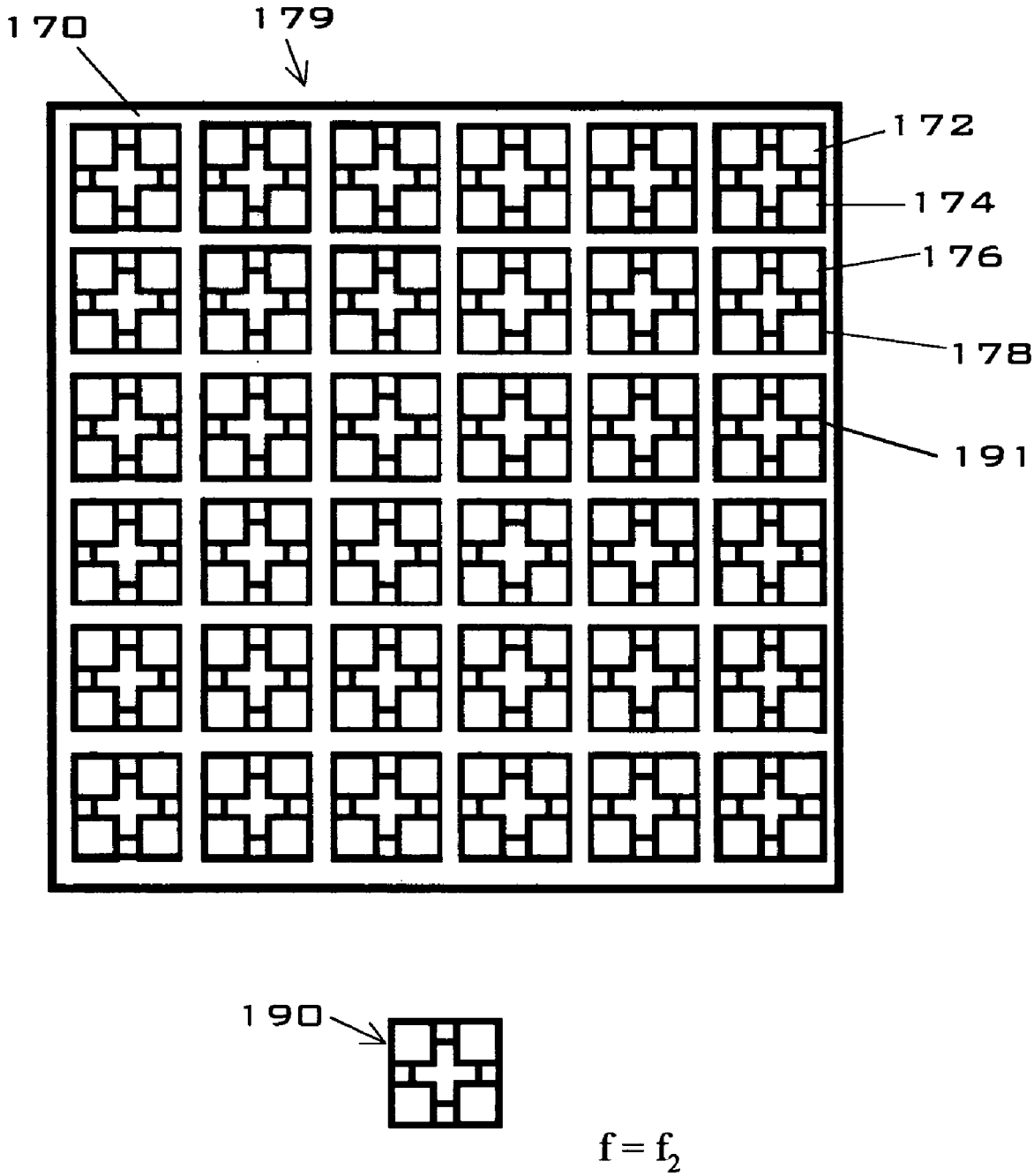

FIGS. 9 and 10 illustrate a reconfigurable four-band antenna 169, 179. The high-band configuration is resonant at $f=f_1$, the two bands in the middle are resonant at $f=f_2=f_1/2$ and $f=f_3=f_1/3$, while the low-band is resonant at $f=f_4=f_1/4$. The structure consists of unit cells or secondary elements on surface 170 configured for the highest band of operation where $f=f_1$, along with a 12×12 element array supported on the surface 170 of a dielectric slab 180. The unit cell 182 comprises a single element. Four elements 172, 174, 176, or 178 are identified in the matrix array. A band 181 around each element further highlights the extent of the unit cell, this band is for illustrative purposes only. For this high-band state, the reconfigurable antenna operates when the external hard switches cause a minimum field (zero voltage) across the adjustable portion of the corresponding passive circuits. Hence, there are no lines indicating an electrical interconnection between any two elements.

In FIG. 10, the antenna 179 utilizes unit cells 190 for a reconfigurable state consisting of a 2×2 matrix of interconnected elements. A 6×6 portion of the corresponding matrix architecture electromagnetic structure (made up of multiple cells 192 similar to cell 190) is also shown, which has an operating frequency of $f=f_2=f_1/2$. The band 191 further illustrates the extent of the unit cell within the structure, and does not indicate a real physical entity. Closed switches provide voltage or power flow to the adjustable portion of the passive circuit so as to achieve electrical interconnection between adjacent elements, in this case between elements 172 and 174, and between elements 176 and 178, respectively.

Figure 11:
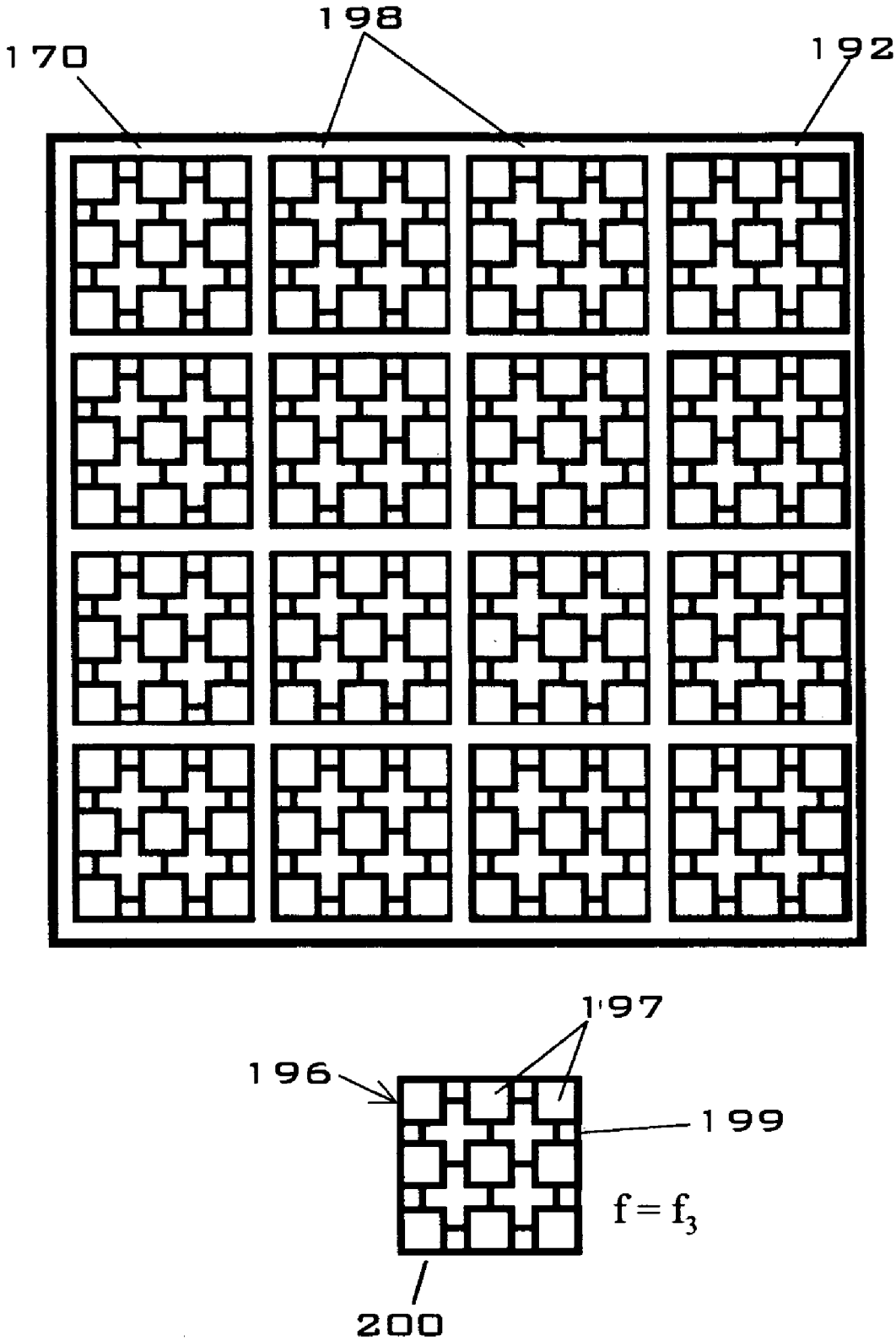

A unit cell 196 (FIG. 11) is composed of a 3×3 matrix of interconnected elements 197. A 4×4 portion 198 of a corresponding matrix architecture with an operating frequency of $f=f_3=f_1/3$ is illustrated. Band 199 further illustrates the extent of the unit cell within the structure, and does not indicate a real physical entity. Elements 197 are interconnected in groups of 9 through closed switches illustrated by the solid lines 200.

Figure 12:
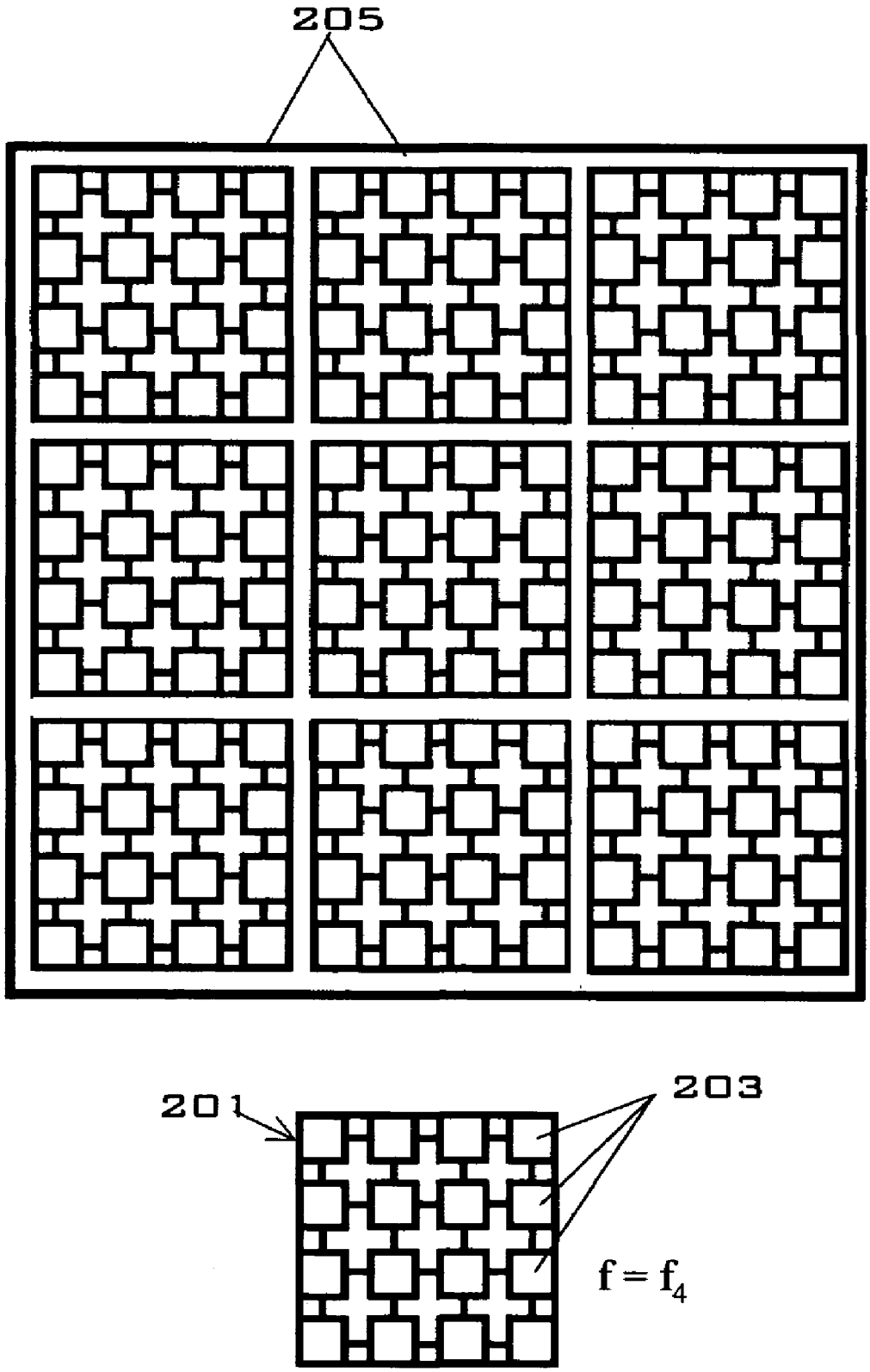

FIG. 12 shows a unit cell 201 comprising a 4×4 matrix of interconnected elements 203. Elements 203 are electrically interconnected via the closed switches illustrated by the solid lines. The individual matrix architecture cell 201 is configured for the lowest band of operation centered at $f=f_4=f_1/4$. A 3×3 portion of the corresponding structure for the low band state is designated with the reference numeral 205. Any desired predetermined pattern of interconnected elements can be provided. This example demonstrates the versatility that can be achieved by incorporating a matrix architecture into the design of a reconfigurable antenna.

Figure 13:
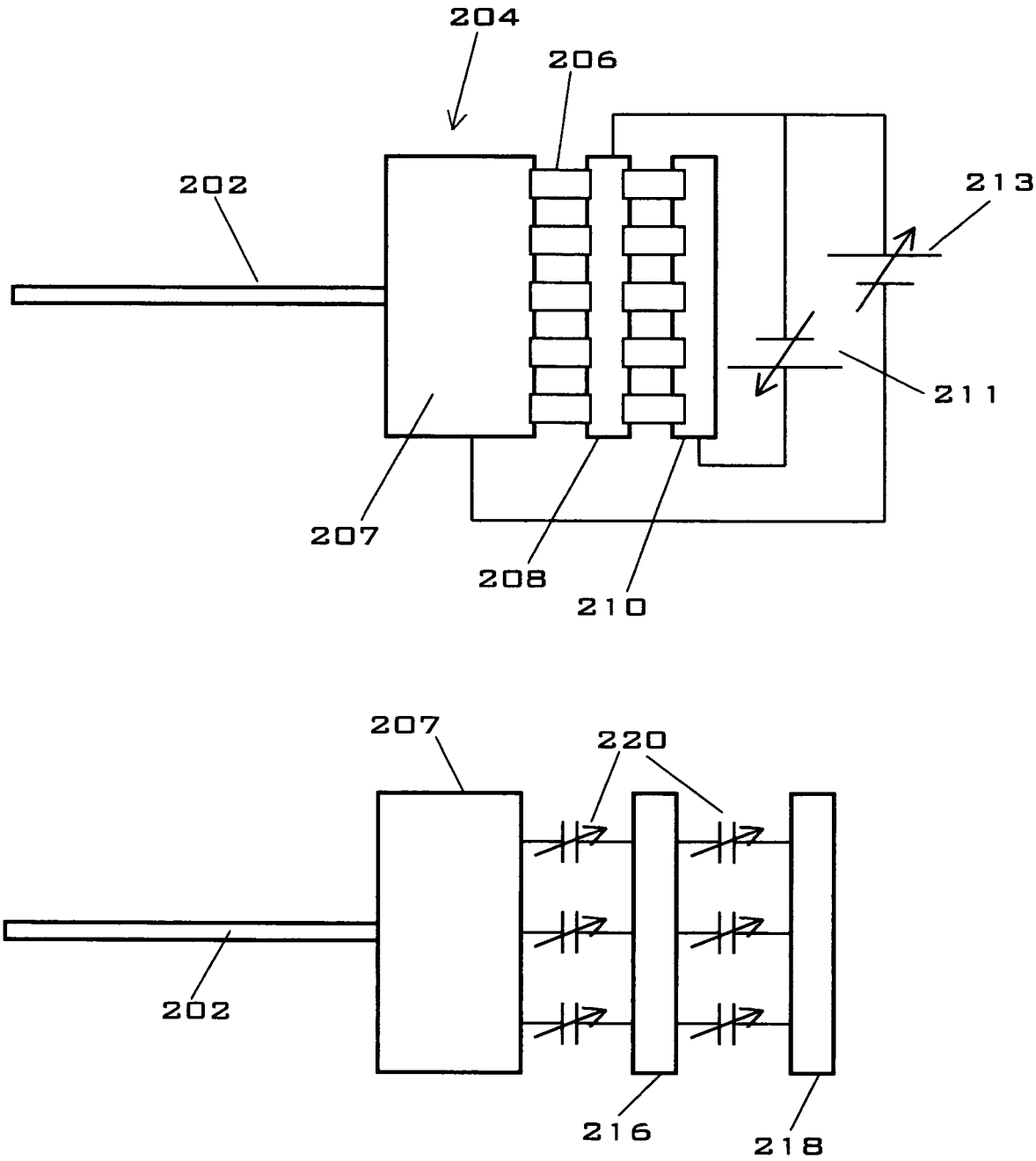
FIG. 13 is a schematic diagram of a frequency-tunable microstrip patch antenna and the equivalent electrical circuit.

FIG. 13 shows a frequency tunable microstrip patch antenna 204 formed from a secondary circuit element. Antenna 204 is connected via a microstrip feed line or waveguide 202 to a half-wave microstrip patch antenna element 207. Banks of BST capacitors 206 interconnect matrix arrays 208, 210. Capacitors 211, 213 used to couple into sections to lower the resonance frequency for frequency tuning. The equivalent circuit 212 has capacitors 220 between 207 and 216, and capacitors 220 between two loading elements 216, 218.

Figure 14:
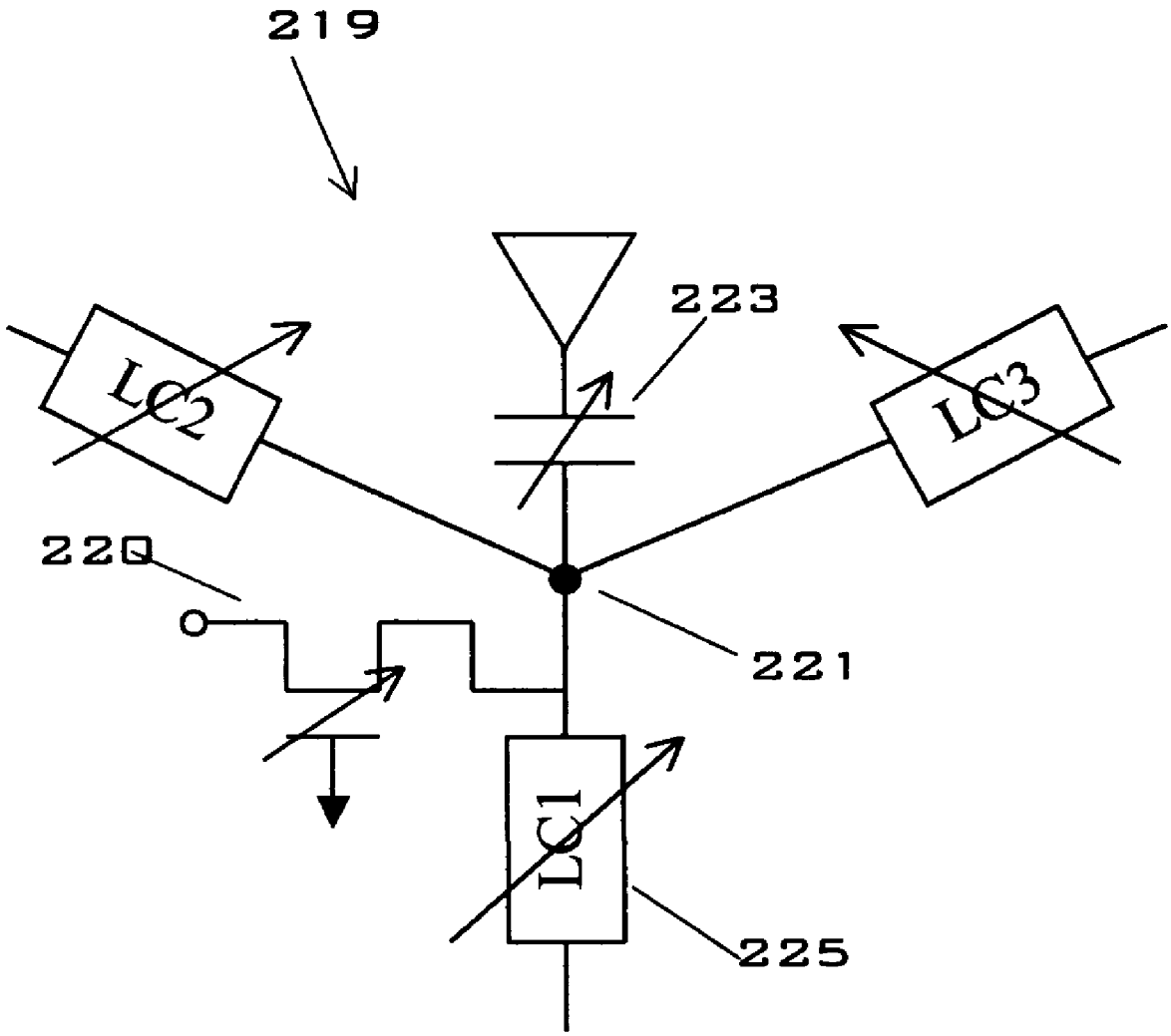
FIG. 14 is a combined pictorial and schematic view of a single tunable antenna element that is preferably disposed within our matrix array.

FIG. 14 shows an exemplary antenna element 219 that forms the building block for a passive circuit interconnected matrix architecture. What is shown is a radiating element of an antenna, considered from the standpoint of the RF characteristics of the radiative element and its connections to other elements. FIG. 14 shows the antenna elements, but does not explicitly show connections to other elements or antenna element connections to antenna feed points. A secondary element 220 within a matrix communicates to node 221, which comprises the connection junction of a plurality of other L/C tuning circuits as discussed previously in connection with FIGS. 7 and 8. FIG. 14 shows a resultant tuning capacitor 223 for tuning the local frequency characteristics, the local phase, and its interconnection with other elements.

The single antenna pixel 219 (FIG. 14) can employ a variety of tunable elements or combinations of tunable elements, all provided through our matrix architecture. From a practical perspective, tunable capacitors offer the simplest tuning, and capacitive tuning effects are obtained by varying the dielectric permittivity in the local region. Tunable dielectrics result within the thin film substrate layers, as discussed in connection with FIG. 3.

Connections to other elements are made using single or multiple L/C networks 225 that can provide connection or isolation. For some antenna designs, connections would be primarily or exclusively to adjacent or nearby elements, but longer distance connections are also possible. The number of elements that can be usefully series connected by L/C networks depends on the "Q" of the reactive portion of the corresponding antenna patch. Connections of three or even more elements are possible using currently available materials. Similarly, individual antenna pixel elements are fed from a fixed antenna feed point or feed points. For multiple feed points, the feed point phase can be the same or varied for different feed points. In either case, the local phase of the individual antenna element can be varied relative to the feed point and to other elements by the tunable phase element (for example a microstrip line with a tunable dielectric).

Figure 15:
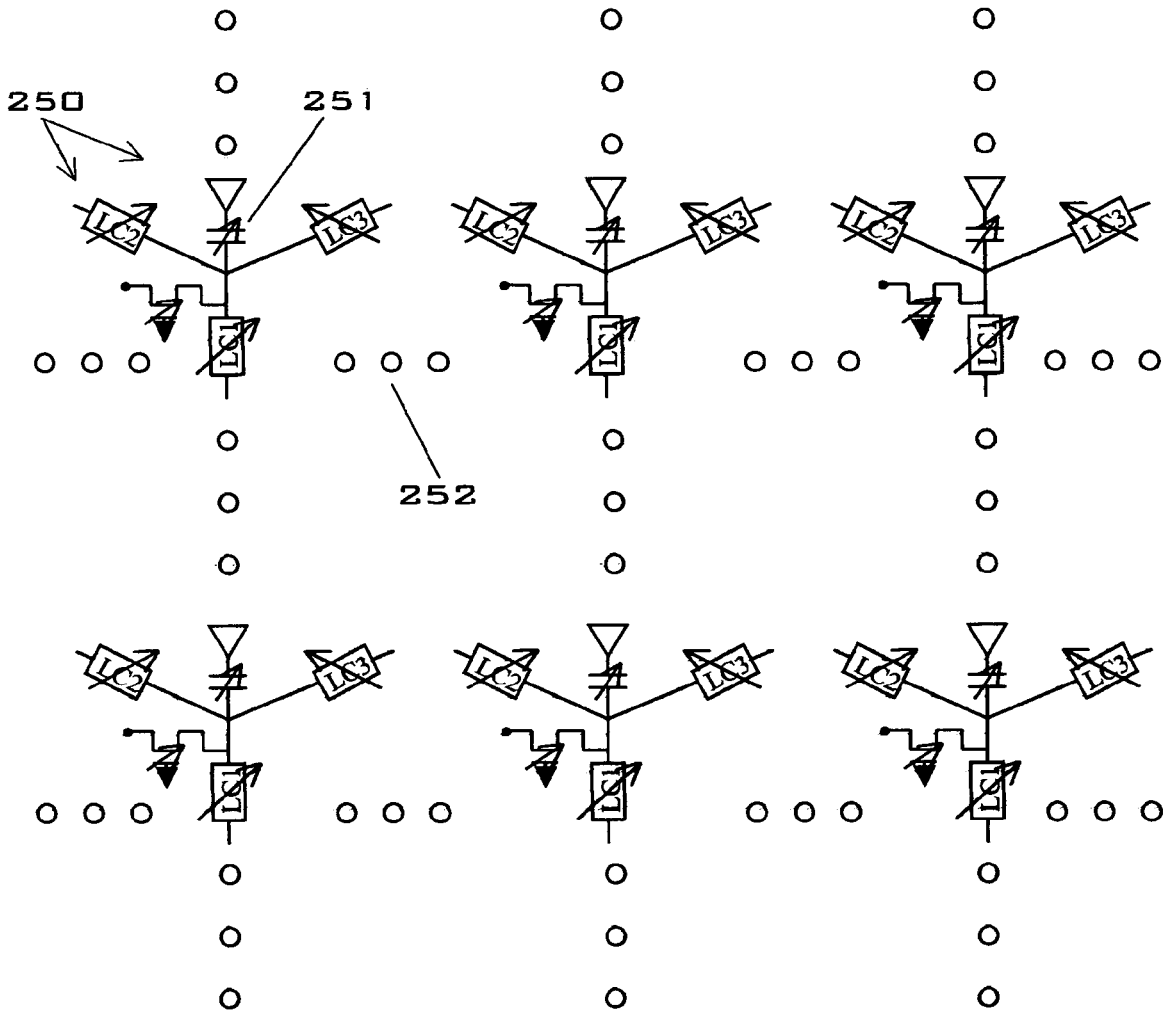
FIG. 15 is a combined pictorial and schematic views of an antenna with multiple, tunable elements arranged within the preferred matrix array.
Figure 16:
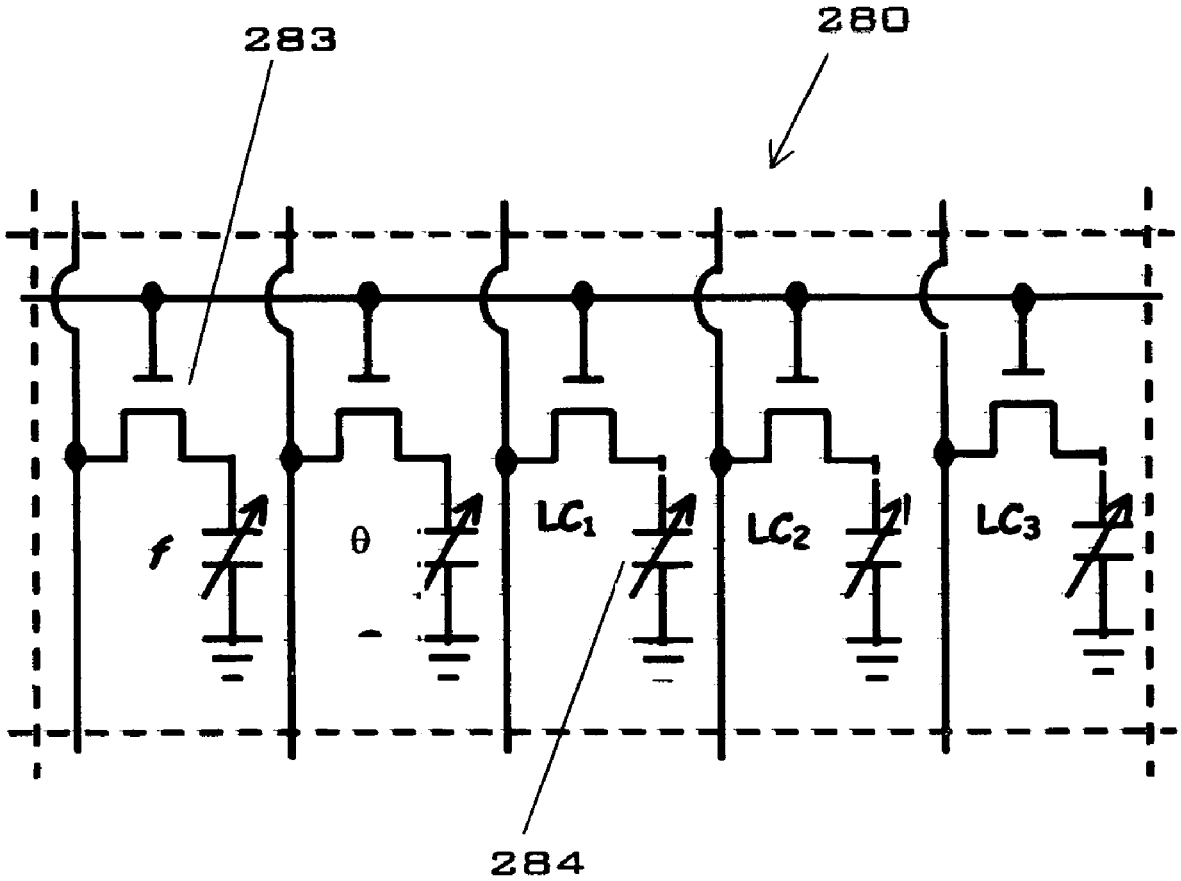
FIG. 16 is an abbreviated schematic diagram of a single tunable element, showing individual FETs used for tuning.
Figure 17:
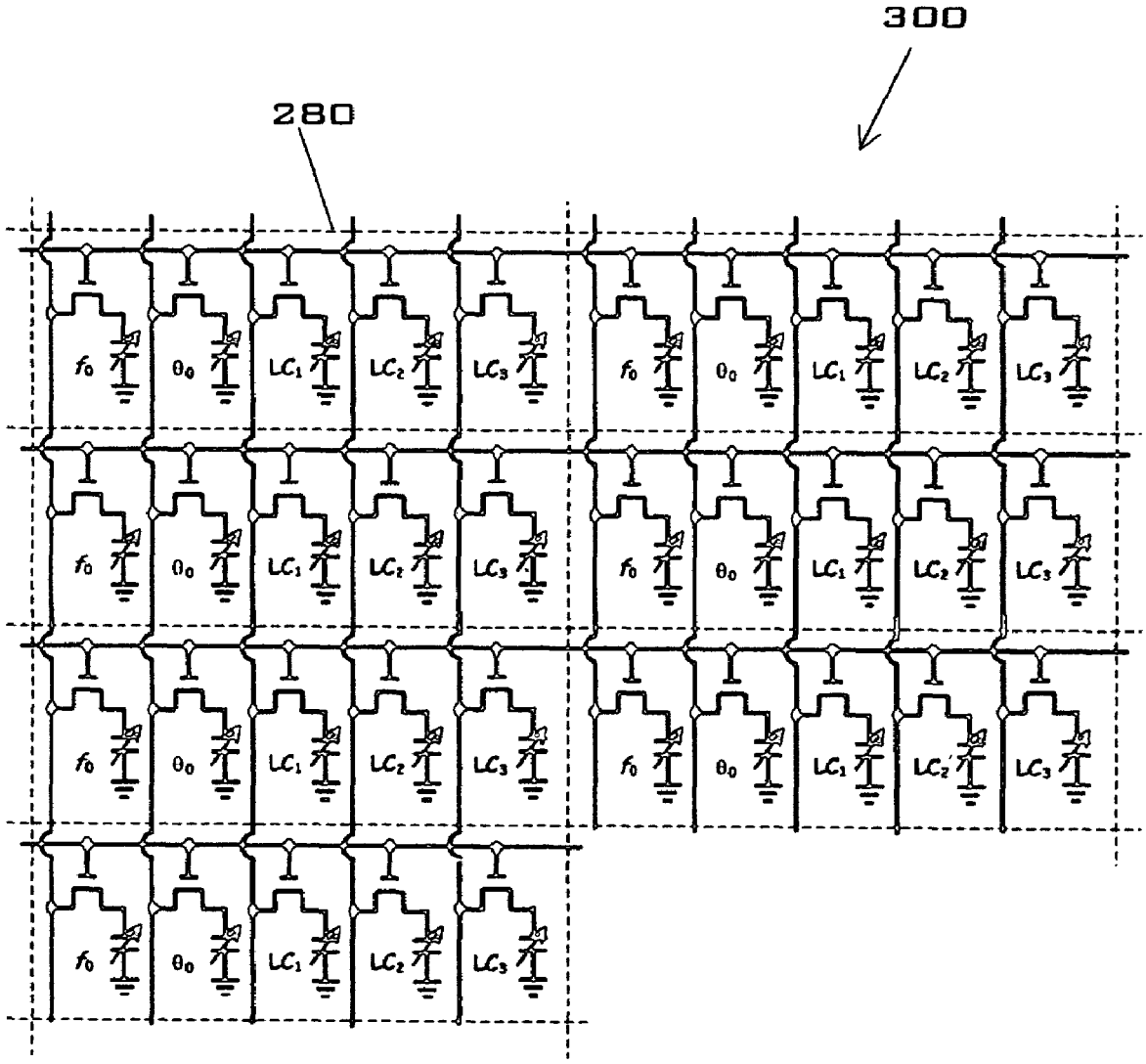
FIG. 17 is a fragmentary schematic diagram of a section of a matrix-controlled antenna array.

FIG. 15 shows an array 250 of tuned, radiating elements. A single radiative element 251 is constructed as in FIG. 14. Resonant inter-element couplings are designated as a sequence of dots 252. Transistor switches in the selected row are turned ON and the data required for each antenna element in the row is applied through orthogonal column lines. Low-cost, off-the-shelf ICs are available to provide row and column signals, typically for pennies per line, with single line update times typically near 10 microseconds. This approach is employed to control tunable elements of a matrix architecture antenna array, as shown in FIGS. 16 and 17.

Efficient and low-cost control of the large number of tuning elements is a key requirement for this matrix architecture antenna approach. Ordinarily, the number of connecting wires employed directly between multiple tuning elements and the pertinent control system is unwieldy, for even a small number of elements and impractical for arrays with large numbers of elements. As seen in FIG. 16, a tunable, antenna element is designated by the reference numeral 280. Transistors 283 control the tunable elements 284 in the pixel. For the example pixel shown, five transistors are used. FIG. 17 shows a small section of a large-scale, matrix architecture antenna array 300 comprising numerous pixels 280 arranged in multiple rows and columns in the desired matrix architecture.

Electrical Addressing

Arrays of transistors or other switching devices can be electrically addressed using methods known in the art. For example, an array of thin film transistors can be controlled using matrix-addressing techniques well known in relation to the matrix addressing of active matrix liquid crystal displays. Addressing circuitry (or other switching circuitry) can in whole or in part be supported on the same surface of the dielectric layer as the conducting patches (for example, along side or underneath conducting patches), on the other surface of the dielectric layer (for example, connected to the conducting patches through conducting paths extending through the dielectric layer), on the other side of the conducting sheet (with appropriate connections), or elsewhere (for example, proximate to one or more edges of the dielectric layer, possibly in a region without conducting patches).

Crossed stripe patterns of electrodes, similar to those used in liquid crystal displays, can be used to apply addressing signals, along with transistors (such as thin film transistors) or diodes, storage capacitors, resistors, and other components, which can be designed using principles analogous to those used in active matrix liquid crystal displays. Electrodes can be supported by the dielectric layer, and may also be patterned into conducting layers proximate to the dielectric layer.

Software

The use of genetic algorithms to design patch shapes for antennas is described in "Genetically engineered multi-band high-impedance surfaces", Kern et al., *Microwave Opt. Technol. Lett.,* 1138(5), 11400–11403 (2003), and "A genetic algorithm approach to the design of ultra-thin electromagnetic bandgap absorbers", D. J. Kern and D. H. Werner, *Microwave Opt. Technol. Lett.,* 1138(1), 61–1164 (2003). Genetic algorithms are also described in U.S. Pat. App. Pub. No. 2004/0001021 to Choo et al., and elsewhere. For purposes of disclosure, all of the foregoing references are incorporated by reference herein.

Genetic algorithms can be used to derive a number of unit cell configurations, for example so as to provide desired operation at one or more frequencies. The unit cell configuration of a matrix architecture antenna can then be changed between one or more of the desired configurations using methods described elsewhere in this specification.

Curved, Flexible, and Other Conformations

A reconfigurable electromagnetic structure can be provided having curved or other three-dimensional surface profile, or as part of a flexible structure. For example, a reconfigurable antenna can comprise a flexible dielectric layer (such as a polymer film), having a flexible conducting layer on one surface, and a reconfigurable matrix addressable array of adjustable passive circuits on an opposed surface. The conducting patches can be a flexible conductor. Flexible conductors are well known in the art, and include conducting polymers and metal foils. Optionally, the conducting patches can be substantially non-flexible, the structure flexing within regions between conducting patches, and/or between unit cells of the matrix array. The circuitry used in a flexible reconfigurable electromagnetic structure can include thin film transistors, for example, polysilicon thin film transistors have been used in flexible liquid crystal displays, and be composed of multi-ply construction of flexible dielectric substrates such as R/FLEX, a commercial product produced by Rogers Corporation, or single copper clad Kapton as produced by DuPont Corporation.

A reconfigurable array can have an arbitrary curved profile, for example so as to match the outer surface of a vehicle, electronic device, or other device. The curved profile can be permanent, or may be provided by conforming a flexible device to a curved profile. Discrete devices can themselves be conformal through either coating or micromachining. A flexible dielectric layer can support a reconfigurable structures, with the flexible dielectric layer being conformed with and proximate to an existing curved metal surface so as to provide, for example, a receiver antenna.

A reconfigurable electromagnetic structure can be used in a reflector, for example to focus or otherwise control beams of electromagnetic radiation. A reconfigurable electromagnetic structure can also be used in an electromagnetic absorber. The resonant frequency of the structure having a reconfigurable capability can be adjusted to provide the required absorption or reflection properties. For example, the use of an AMC as a metaferrite is described in copending U.S. patent application Ser. No. 10/755,539, filed Jan. 12, 2004, and a reconfigurable FSS can be used to optimize or otherwise spatially modify metaferrite behavior of an AMC. Further, a reconfigurable electromagnetic structure can provide a surface having selected regions having a desired property, one or more other selective regions providing another property. For example, a reflecting region can be bounded by an absorbing region or different regions acting selectively as distinct antenna.

For example, a reconfigurable electromagnetic structure can be provided on an object, such as a vehicle, and configured so that a sub-region of the structure acts as a reflector, and another sub-region acts as an absorber. Hence, the apparent dimensions of the object (if any), as determined by radar, can controlled. Further, the local adjustment capabilities of such a structure can be used, for example while under friendly radar surveillance, to minimize radar reflectivity. Further, different adjustment parameters can be stored in a memory for use in different conditions to maintain minimum radar reflectivity, for example adjustment parameters can be correlated with temperature, humidity, rain or dry conditions, object speed and orientation, and the like. Adjustment parameters may include electrical signals provided to switches and/or tunable elements, for example as described in more detail above.

Adjustments to a reconfigurable electromagnetic structure can be made while a source of power is available. The adjustments may then be stored for a period of time after the power is removed. For example, tunable dielectrics can be tuned by electrical potentials stored on low-leakage capacitors.

Combining a reconfigrable antenna with an AMC back plane enables a low profile antenna, for example within a cell phone, wireless modem, pager, vehicle antenna, personal digital assistant, laptop computer, modem, other wireless receiver, transmitter, or transceiver, or other device.

Applications include, but are not limited to, the development of new designs for low-profile multi-function frequency agile phased array antennas that have superior performance compared to conventional systems. The properties of these matrix architecture adjustable parameter electromagnetic structures can also be exploited to design frequency-agile phased array systems with wide-angle (e.g., hemispherical) coverage and reduced coupling due to the suppression of surface waves.

Electronic Control

Figure 18:
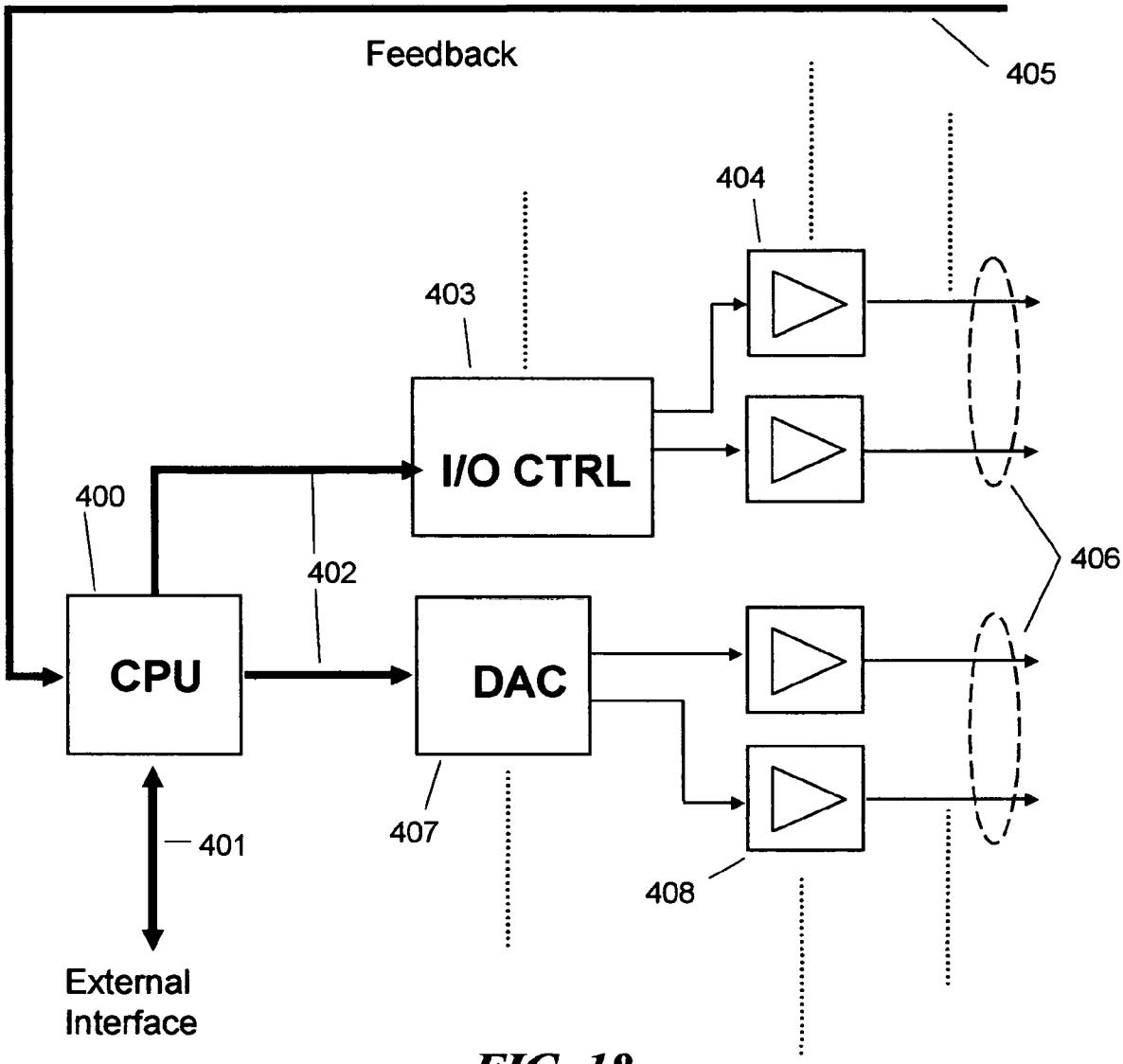
FIG. 18 is an exemplary control circuit for a matrix architecture having secondary devices thereon.

Referring to FIG. 18, electronic control can be implemented via the exemplary circuit shown and described. All antenna control algorithms are implemented via a digital processor 400 consisting of an embedded micro-controller, Digital Signal Processor, PC-based controller, or a plurality of digital processors. The digital processor 400 may include all necessary peripherals to comprise a complete digital processing solution. Exemplary peripherals include but are not limited to a system bus, serial and communications ports, volatile and non-volatile memories such as static RAM and FLASH RAM, system power supplies and converters, and clock/timing circuits. The digital controller 400 is electrically connected to matrix control blocks 403 and 407 via a high-speed bus 402. The high-speed bus 402 may include a local CPU parallel system bus, a high-speed serial bus such as USB or FireWire, or a plurality of digital interconnecting buses.

The DAC 407 is a digital to analog converter, as would be understood in the art, that generates the analog tuning potentials (voltages) for adaptive/tunable devices in the matrix array. The DAC 407 is controlled directly by the digital controller 400 and the tuning/control algorithms that reside in firmware/software in a stored memory. The DAC 407 may also comprise a plurality of digital to analog converter subsystems thereby facilitating scaling to any number of tuning control lines.

The I/O controller 403 is a control signal/pattern generator producing the matrix switch on/off signals. The digital controller 400 communicates directly with the I/O controller 403 via a high-speed bus 402 to enable and/or disable the matrix switch elements. The antenna tuning and control algorithms has both asynchronous and synchronous access to the matrix control switches via the I/O controller 403 to facilitate antenna or like capabilities. The I/O controller 403 is implemented with discrete logic devices or modern programmable logic devices including, but not limited to, GALs, PALs, PLDs, CPLDs, and FPGA's. The I/O controller 403 may also comprise a plurality of logic devices to facilitate scaling to any number matrix row/column control lines.

Both I/O controller 403 and DAC 407 pass through translation and buffering circuitry 404 and 408. Translation and buffering circuitry provides proper signal conditioning and adaptation such that the electronics described in FIG. 18 is interfaced to any adaptive tunable element(s) and matrix switch element(s). The translation and buffering stages 404 and 408 are implemented with any type of level translation and buffering electronics including, but are not limited to, discrete semiconductors, power amplifiers and operational amplifiers.

Control lines 406 from DAC 407 and I/O controller 403 are physically interfaced to the antenna matrix. Physical connection is comprised of connection technology understood in the art, including flex, ACF bonds, and edge-card. The described circuitry may be integrated directly onto the antenna structure itself in which a bridging interconnection is not required.

The digital controller 400 may also input any feedback information 405 from the antenna matrix for implementing a direct feedback control system. Feedback control information may include antenna performance variables, environmental variables such as temperature and humidity, and state of health information. The CPU 400 with external interface 401 communications with an external host. This communication interface may consist of a digital interface, examples including USB, RS-232, RS-485/422, FireWire, PCI, ISA, VME, and Ethernet. The communications interface may be wired or wireless. The external interface 401 may allow any external host to have control any part of the antenna subsystem and allow the paralleling of computation resources of the electronics in FIG. 18 such that a plurality of such electronics systems are operated in parallel to control any number of antenna matrices.

From the foregoing, it will be seen that this invention is one well adapted to obtain all the ends and objects herein set forth, together with other advantages which are inherent to the structure.

It will be understood that certain features and sub-combinations are of utility and may be employed without reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A sheet-wise, bimorph composited structure comprising:

a first outer layer composed of an ultra, high-strain polymer, a first PVDF-TFE layer enabling a locally deformable structure, said first PVDF-TFE layer contacting said first outer layer;

a dielectric layer comprising a ferrotunable material and having embedded therein a matrix circuit comprising a plurality of secondary circuits, said dielectric layer contacting said first PVDF-TFE layer opposite of said first outer layer;

a non-conducting layer composed of a polymer sheet contacting said dielectric layer opposite of said first PVDF-TFE layer;

a layer having therein a control circuitry in a matrix arrangement providing an electromagnetic structure in which frequency characteristics of said secondary circuits within said dielectric layer are varied by permittivity changes within said control circuitry so as to function as a frequency variable, voltage-controlled, microwave antenna array, said layer contacting said non-conducting layer opposite of said dielectric layer;

a second PVDF-TFE layer enabling a locally deformable structure contacting said layer opposite of said non-conducting layer; and a second outer layer composed of an ultra, high-strain polymer contacting said second PVFD-TFE layer opposite of said layer.

2. The sheet-wise, bimorph composited structure of claim 1, wherein said secondary circuits are selectively interconnected via a plurality of switches each enabled by a magnetic field, a thermal field, or a vibration.

3. The sheet-wise, bimorph composited structure of claim 1, wherein said secondary circuits are selectively interconnected via a plurality of switches each enabled by an electrical signal, an electromagnetic radiation, an actuation, or a mechanical reorientation.

* * * * *